US005302248A

United States Patent [19]

Weinstock et al.

[11] Patent Number: 5,302,248

[45] Date of Patent: Apr. 12, 1994

[54] DELIGNIFICATION OF WOOD PULP BY VANADIUM-SUBSTITUTED POLYOXOMETALATES

[75] Inventors: Ira A. Weinstock, Madison, Wis.; Craig L. Hill, Atlanta, Ga.

[73] Assignee: The United States of America as represented by the Secretary of Agricultare, Washington, D.C.

[21] Appl. No.: 937,634

[22] Filed: Aug. 28, 1992

[51] Int. Cl.[5] ..... D21C 3/00

[52] U.S. Cl. ..... 162/79; 530/506

[58] Field of Search ..... 162/79; 530/500, 506

[56] References Cited

U.S. PATENT DOCUMENTS

| | | | |
|---|---|---|---|
| 2,779,656 | 1/1957 | Fennel et al. | 8/106 |
| 3,657,065 | 4/1972 | Smith et al. | 162/65 |
| 4,283,301 | 8/1981 | Diehl | 252/102 |
| 4,486,394 | 12/1984 | Nguyen | 423/155 |
| 4,773,966 | 9/1988 | Huynh | 162/79 |
| 4,839,008 | 6/1989 | Hill | 204/157.15 |
| 4,864,041 | 9/1989 | Hill | 549/513 |
| 4,931,207 | 6/1990 | Cramer et al. | 252/187.26 |
| 5,041,142 | 8/1991 | Ellis | 8/111 |

OTHER PUBLICATIONS

Chambers et al., Inorganic Chem.; 30:2776–2781, 1991.

Venturello et al.; *J. Org. Chem.*; 51:1599–1602, 1986.

Deutsch et al.; *Tappi;* 62:53–55, 1979.

Sattari et al.; *J. Chem. Soc., Chem. Commun.;* 634–635; 1990.

Ishii et al.; *J. Org. Chem.;* 53:3587–3593, 1988.

Ali et al.; *J. Chem. Soc., Chem. Commun.;* 825–826, 1989.

Lyon et al.; *J. Am. Chem. Soc.;* 113:7209–7221, 1991.

Mansuy et al.; *J. Am. Chem. Soc.;* 113:7222–7226, 1991.

Chambers et al.; *Inorg. Chem.;* 28:2509–2511, 1989.

*Primary Examiner*—W. Gary Jones

*Assistant Examiner*—Dean T. Nguyen

*Attorney, Agent, or Firm*—M. Howard Silverstein; John D. Fado; Janet I. Stockhausen

[57] ABSTRACT

A method for delignifying wood pulp is disclosed. The method comprises the steps of obtaining a wood pulp and exposing the wood pulp to a polyoxometalate of the formula $[V_nMo_mW_lNb_oTa_p(TM)_q(MG)_rO_s]^{x-}$ where n is 1–18, m is 0–40, l is 0–40, o is 0–10, p is 0–10, $q \leqq 6$, $r \leqq 6$, TM is a d-electron-containing transition metal ion, and MG is a main group ion, provided that $n+m+o+l+p \geqq 4$ and s is sufficiently large that $x>o$. The exposure is under conditions wherein the polyoxometalate is reduced. In a preferable form of the invention, the method additionally comprises the step of reoxidizing the polyoxometalate.

13 Claims, 18 Drawing Sheets

$[(X^{n+})M_{12}O_{40}]^{(8-n)-}$ $[(X^{n+})_2M_{18}O_{62}]^{(16-2n)-}$

DELIGNIFICATION OF WOOD PULP BY VANADIUM-SUBSTITUTED POLYOXOMETALATES

FIELD OF THE INVENTION

The field of the present invention in general is the use of transition metal-derived agents in the delignification of wood or wood pulp. Specifically, the field of the present invention is the use of vanadium-substituted polyoxometalates in wood pulp bleaching.

BACKGROUND OF THE INVENTION

Pulping. The transition of a tree into paper involves several discrete stages. Stage one is the debarking of the tree and the conversion of the tree into wood chips. Stage two is the conversion of wood chips into pulp. This conversion may be by either mechanical or chemical means.

Bleaching is the third stage. Delignification is the first step in the bleaching of chemical pulps. Lignin, a complex polymer derived from aromatic alcohols, is one of the main constituents of wood. During the early stages of bleaching, residual lignin, which constitutes 3-6% of the pulp, is removed. Currently, this is typically done by treatment of the pulp with elemental chlorine at low pH, followed by extraction with hot alkali. Once a significant portion of the residual lignin has been removed, the pulp may be whitened, by a variety of means, to high brightness. Chlorine dioxide is commonly used in the brightening step.

Although chlorine compounds are effective and relatively inexpensive, their use in pulp mills results in the generation and release of chlorinated organic materials, including dioxins, into rivers and streams. Due to increasing regulatory pressures and consumer demand, new, non-chlorine bleaching technologies are urgently needed by manufacturers of paper-grade chemical pulps.

In recent years, attention has been drawn to the potential use of enzymatic processes associated with fungal degradation of lignin to develop environmentally friendly technologies for the pulp and paper industry. In many wood-rotting fungi, extracellular metalloenzymes such as glyoxal oxidase, a copper-containing oxidase, in combination with lignin and manganese peroxidases, both of which contain iron in a protoheme active site, harness the oxidative capability of dioxygen and direct its reactivity to the degradation of lignin within the fiber walls. In this biochemical process, high valent transition metal ions serve as conduits for the flux of electrons from lignin to dioxygen.

Therefore, transition metal ions are known to possess redox properties that are useful in the delignification and bleaching of lignocellulosic materials. However, the behavior of transition metal ions in water is often difficult to control. In aqueous solution, complex equilibria are established between ionic hydroxides and hydrates, as well as between accessible oxidation states of the metal ions. In addition, many transition metal oxides and hydroxides have limited solubilities in water, where the active metals are rapidly lost from solution as solid precipitates. What is needed in the art of pulp bleaching is a reusable transition metal-derived bleaching agent composed of relatively inexpensive and nontoxic materials that is suitable for use in a bleaching procedure.

Polyoxometalates. Polyoxometalates are discrete polymeric structures that form spontaneously when simple oxides of vanadium, niobium, tantalum, molybdenum or tungsten are combined under the appropriate conditions in water (Pope, M. T. *Heteropoly and Isopoly Oxometalates* Springer-Verlag, Berlin, 1983). In a great majority of polyoxometalates, the transition metals are in the $d^o$ electronic configuration which dictates both high resistance to oxidative degradation and an ability to oxidize other materials such as lignin. The principal transition metal ions that form polyoxometalates are tungsten(VI), molybdenum(VI), vanadium(V), niobium(V) and tantalum(V).

Isopolyoxometalates, the simplest of the polyoxometalates, are binary oxides of the formula $[M_mO_y]^{p-}$, where m may vary from two to over 30. For example, if m=2 and M=Mo, then the formula is $[Mo_2O_7]^{2-}$; if m=6, then $[Mo_6O_{19}]^{2-}$; and if m=36, then $[Mo_{36}O_{112}]^{8-}$. Polyoxometalates, in either acid or salt forms, are water soluble and highly resistant to oxidative degradation.

Heteropolyoxometalates have the general formula $[X_xM_mO_y]^{p-}$ and possess a heteroatom, X, at their center. For example, in the α-Keggin structure, $\alpha-[PW_{12}O_{40}]^{3-}$, X is a phosphorus atom. The central phosphorus atom is surrounded by twelve $WO_6$ octahedra.

Removal of a $(M=O)^{4+}$- moiety from the surface of the α-Keggin structure $\alpha-[PM_{12}O_{40}]^{3-}$, where M is molybdenum or tungsten, creates the "lacunary" α-Keggin anion, $\alpha-[PM_{11}O_{39}]^{7-}$. The lacunary α-Keggin ion acts as a pentadentate ligand for redox active transition metal ions, such as vanadium(V) in $\alpha-[PVW_{11}O_{40}]^{4-}$. Further substitution is also possible, giving anions of the form $[X_xM'_m,M_mO_y]^{p-}$, such as $[PV_2Mo_{10}O_{40}]^{5-}$. The redox active metal ions are bound at the surface of the heteropolyanions in much the same way that ferric ions are held within the active sites of lignin or manganese peroxidases. However, while stabilizing the metal ions in solution and controlling their reactivity, the heteropolyanions, unlike enzymes or synthetic porphyrins, are highly resistant to oxidative degradation (Hill, et al., *J. Am. Chem. Soc.* 108:536-538, 1986).

Previously, polyoxometalates have been used as catalysts for oxidation under heterogeneous and homogeneous conditions, analytical stains for biological samples, and for other uses still in development. The use of polyoxometalates in pulp bleaching has neither been described nor suggested.

SUMMARY OF THE INVENTION

In the present invention a variety of vanadium(V) substituted polyoxometalates are used as bleaching agents.

The general formula for a polyoxometalate useful in the present invention is $[V_nMo_mW_lNb_oTa_p(TM)_q(MG)_rO_s]^{x-}$ where n is 1-18, m is 0-40, l is 0-40, o is 0-10, p is 0-10, $q \leqq 6$, $r \leqq 6$, TM is a d-electron-containing transition metal ion, and MG is a main group ion, provided that $n+m+o+l+p \geqq 4$ and s is sufficiently large that $x>o$. The present invention is a method of delignifying pulp comprising the steps of obtaining a wood pulp and exposing the wood pulp to a polyoxometalate of the above general formula under conditions wherein the polyoxometalate is reduced.

Preferably, the wood pulp is exposed to a polyoxometalate of the formula $[V_nO_r]^{x-}$, where $n \geqq 4$, $r \geqq 12$ and $x=2r-5n$, or $[V_nMo_mW_o(TM)_p(MG)_qO_r]^{x-}$, where TM is any d-electron-containing transition metal ion, MG is a main group ion, $1 \leqq n \leqq 8$, $n+m+o \leqq 12$ and $p+q \leqq 4$, or $[V_nMo_mW_o(MG)_pO_r]^{x-}$ where MG is either $P^{5+}$, $As^{5+}$, or $S^{6+}$, $1 \leqq n \leqq 9$, $n+m+o=18$ and $p=2$.

The present invention is also a method of delignifying pulp comprising the steps of obtaining a wood pulp; exposing the wood pulp to a compound of the general formula, wherein the polyoxometalate is reduced; and then oxidizing the reduced polyoxometalate.

Preferably, the reduced polyoxometalate is reoxidized with an oxidant selected from the group consisting of air, dioxygen, hydrogen peroxide and other organic or inorganic peroxides (free acid or salt forms), or ozone.

It is an object of the present invention to delignify hardwood and softwood pulp.

It is an additional object of the present invention to delignify pulp using a polyoxometalate.

It is an additional object of the present invention to employ an oxidant in the bleaching of pulp that may be regenerated by reoxidation of its reduced form.

It is a feature of the present invention that suitable polyoxometalates may be reoxidized with an oxidant selected from the group consisting of air, dioxygen, hydrogen peroxide and other organic or inorganic peroxides (free acid or salt forms), or ozone. These oxidants are more environmentally friendly than chlorine compounds.

It is another feature of the present invention that a polyoxometalate compound may be used as an oxidant in a repeated bleaching sequence.

Other features, objects and advantages of the present invention will become apparent upon examination of the specification, claims and drawings.

DESCRIPTION OF THE FIGURES

FIG. 1 is a structural drawing of two polyoxometalates.

DESCRIPTION OF THE INVENTION

Figure 1A:
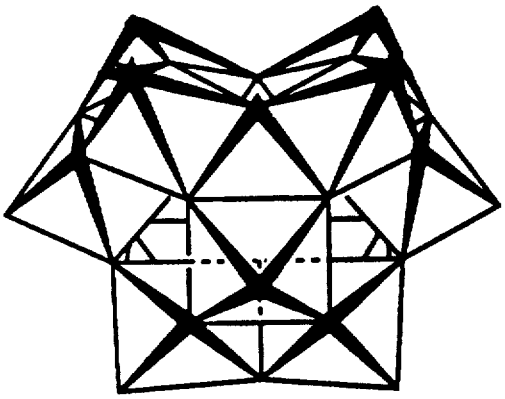
FIG. 1*a* is a Keggin structure of the formula $[(X^{n+})M_{12}O_{40}]^{(8-n)-}$.

The present invention is a method for removing substantial quantities of residual lignin from pulp. As such, it is an effective alternative to chlorine and plays a similar role in the bleaching process.

In General

The first step in the present invention is the production of a wood pulp. Wood pulps may be produced by any conventional chemical method, including both kraft and non-kraft pulps. Suitable pulp production methods are described in "Pulp and Paper Manufacture," 2nd Edition, Volume I, *The Pulping of Wood*, R.G. Macdonald and J.N. Franklin Eds., McGraw-Hill Book Company, New York, 1969.

Wood pulps are generally divided into softwood pulps (e.g., pine pulps) and hardwood pulps (e.g., aspen pulps). Softwood kraft pulp is the most difficult to delignify because lignin is more abundant in softwoods than in hardwoods. Due to structural differences, largely attributable to the lower average number of methoxy groups per phenyl ring, softwood lignin is less susceptible to oxidative degradation. The Examples below describe the efficiency of the method of the present invention with softwood kraft pulp. However, the present invention is suitable for delignification of hardwood pulps also.

Polyoxometalate Bleaching System

The next step of the present invention is the exposure of the pulp to a polyoxometalate. Polyoxometalates suitable for the present invention are applied as stoichiometric oxidants, much as chlorine and chlorine dioxide are currently. The general formula $[V_nMo_mW_lNb_oTa_p(TM)_q(MG)_rO_s]^{x-}$ where n is 1–18, m is 0–40, l is 0–40, o is 0–10, p is 0–10, $q \leqq 6$, $r \leqq 6$, TM is a d-electron-containing transition metal ion, and MG is a main group ion, provided that $n+m+o+l+p \geqq 4$ and s is sufficiently large that $x>o$. In this general formula, it is crucial that the vanadium ions are in their highest ($d^o$, +5) oxidation state. MG is typically $B^{3+}$, $Al^{3+}$, $Si^{4+}$, $Ge^{4+}$, $P^{5+}$, $As^{5+}$ or $S^{6+}$.

Preferably, the polyoxometalates are of one of three different formulas that are subsets of the general formula:

Formula 1, an isopolyvanadate, is $[V_nO_r]^{x-}$, where $n \geqq 4$, $r \geqq 12$ and $x=2r-5n$. $Na_6[V_{10}O_{28}]$, compound 4 in the Examples below, is an example of a sodium salt of a polyoxometalate of this formula.

Formula 2, the Keggin structure, is $[V_nMo_mW_o(TM)_p(MG)_qO_r]^{x-}$, where TM is any d-electron-containing transition metal, MG is a main group ion, $1 \leqq n \leqq 8$, $n+m+o \leqq 12$ and $p+q \leqq 4$. $H_5[PV_2Mo_{10}O_{40}]$, compound 1, is an example of an acid of this formula. $Na_4[PVW_{11}O_{40}]$, compound 2, is an example of a sodium salt.

Formula 3, the Wells-Dawson structure, is $[V_nMo_mW_o(MG)_pO_r]^{x-}$ where MG is either $P^{5+}$, $As^{5+}$, or $S^{6+}$, $1 \leqq n \leqq 9$, $n+m+o=18$, and $p=2$. $H_9[P_2V_3W_{15}O_{62}]$, compound 3, is an example of this structure. Although many other possible structural formulas are known, these structures are suitable since they are the most well-known and some of the easiest to obtain.

Figure 1B:
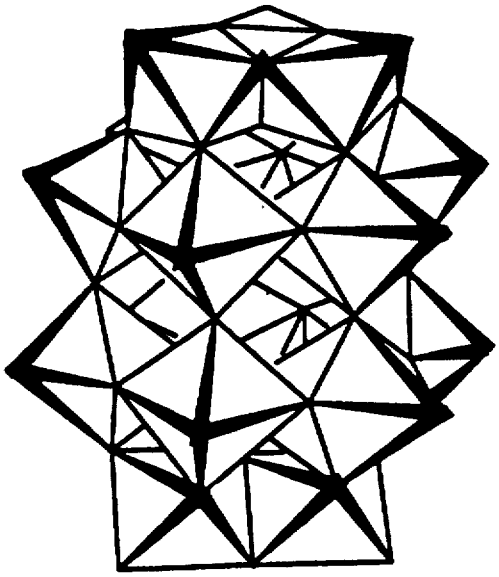
FIG. 1*b* is a Wells-Dawson structure of the formula $[(X^{n+})_2M_{18}O_{62}]^{(16-2n)-}$. The heteroatoms, $X^{n+}$, in these two structures reside in internal tetrahedral cavities and have been omitted in the drawing for clarity.

FIG. 1 is a diagram of two polyoxometalates of the formulas $[(X^{n+})M_{12}O_{40}]^{(8-n)-}$ and $[(X^{n+})_2M_{18}O_{62}]^{(16-2n)-}$.

Polyoxometalate salts are generally water soluble (hydrophilic). However, hydrophobic forms can be made easily and are suitable for use in selective bleaching with solvents other than water. Some cations suitable for formation of hydrophobic forms are defined in U.S. Pat. No. 4,864,041 (inventor: Craig L. Hill).

The polyoxometalate of the present invention is typically in an acid, salt or acid-salt form. For example, compounds 1 and 3 are in acid form. Suitable cations for salt formation are $Li^+$, $Na^+$, $K^+$, $Cs^+$, $NH_4^+$ and $(CH_3)_4N^+$ which may be replaced in part (acid-salt form) or in full (acid form) by protons ($H^+$). For example, polyoxometalate compounds 2 and 4 have a sodium counter ion. The listed cations are sensible choices, but there are others that are available and cost effective.

The present invention involves the step of oxidative degradation of residual lignin by the polyoxometalates. Another embodiment of the present invention additionally has the step of regeneration of the polyoxometalates with chlorine-free oxidants. In the first step (eq. 1), mixtures of water, pulp and a fully oxidized polyoxometalate ($P_{ox}$), are heated, preferably in a sealed vessel. During the reaction, the polyoxometalate is reduced, as the lignin-derived material within the pulp is oxidized. The reduced polyoxometalate ($P_{red}$) must be re-oxidized before it can be used again. This is done by treating the polyoxometalate solution with chlorine-free oxidants such as air, dioxygen, hydrogen peroxide and other organic or inorganic peroxides (free acid or salt forms), or ozone (eq. 2). Alternatively, reoxidation (eq. 2) could be performed at the same time as reduction (eq. 1), thus omitting the necessity for two separate steps.

$$\text{Pulp}+P_{ox} \rightarrow \text{Bleached Pulp}+P_{red} \quad (1)$$

$$P_{red}+O_2+4H^+ \rightarrow P_{ox}+2H_2O \quad (2)$$

As described below in the examples, aqueous polyoxometalate solutions, preferably 0.001 to 0.10M, are prepared with a pH of 1.5 or higher. The polyoxometalate may be prepared as in references given in the Examples or by other standard procedures. Pulp is added to the polyoxometalate solution to a consistency of approximately 1-12%. The mixture is heated in a sealed vessel either in the presence or absence of oxygen (V stage). The temperature and duration of polyoxometalate treatment will depend upon other variables, such as the nature of the pulp, the pH of the polyoxometalate solution and the nature and concentration of the polyoxometalate.

An attractive feature of polyoxometalates is that they are reversible oxidants and could thus function as mediating elements in a closed-loop bleaching system in which used polyoxometalate solutions are regenerated by treatment with chlorine-free oxidants. Example 9a below describes the comparison of the oxidative potential of the vanadium(V)/vanadium(IV) couple with other oxidants, indicating that vanadium (IV) is thermodynamically capable of reoxidation by all of these oxidants.

To oxidize the reduced polyoxometalate, the polyoxometalate solution is collected after the reaction is complete, titrated with ceric ammonium sulfate to determine the extent of polyoxometalate reduction, and reoxidized. Titration with ceric ammonium sulfate is useful for monitoring the reduction of the polyoxometalate solutions, but is not an essential part of the bleaching process itself. The oxidant is preferably air, dioxygen, peroxides, or ozone.

The pulps are washed with water and extracted for 1-3 hours at 60°-100° C. in 1.0% NaOH (E stage). The cycle may be repeated in a VEVE sequence, followed by an alkaline hydrogen peroxide (P) stage. For the P stage, typically 30% aqueous hydrogen peroxide is added to a mixture of pulp and dilute alkali to give a final pH of approximately 9-11 and a consistency of 1-12%. The mixture is then heated for 1-2 hours at 60°-85° C. The quantity of hydrogen peroxide, defined as weight percent relative to the O/D. (oven dried) weight of the pulp may vary from 1-40%.

In the bleaching of chemical pulps, the polyoxometalates react with lignin to render it more susceptible to extraction with hot alkali. Since many pulping processes, including the Kraft process, require cooking wood chips in hot alkali, we envision that polyoxometalates will be useful in commercial pulping because of the role that polyoxometalates play in the bleaching of Kraft pulp. Thus, the present invention includes treating wood chips or wood meal with polyoxometalates, under conditions analogous to those used in the V stage of the bleaching process, and then pulping the wood chips or meal under alkaline conditions. The result is that greater reductions in lignin content are found, after alkaline pulping, in polyoxometalate treated wood, than in wood pulped under the same conditions, but with no polyoxometalate pre-treatment.

EXAMPLES

Bleaching of chemical pulps. Representative complexes from three classes of vanadium-containing polyoxometalates, differing from one another in both composition and structure, were evaluated. The complexes evaluated were as follows: a phosphomolybdovanadate, $H_5[PV_2Mo_{10}O_{40}]$ (compound 1) (Kozhevnikov, I. V., et al. *Russian Chemical Reviews*, 51:1075-1088, 1982); the phosphotungstovanadates $Na_4[PVW_{11}O_{40}]$ (compound 2) (Kuznetsova, L. I., et al., *Inorganica Chimica Acta*, 167, 223-231, 1990) and $H_9[P_2V_3W_{15}O_{62}]$ (compound 3) Finke, R.G., et al, *J. Am. Chem. Soc.* 108, 2947-2960, 1986); and an isopolyvanadate, $Na_6[V_{10}O_{28}]$ (compound 4).

To demonstrate the effectiveness of the polyoxometalates, the amount of residual lignin remaining after the polyoxometalate treatment was monitored. Positive results, relative to controls, are more pronounced after subsequent extraction of the pulp with 1.0% aqueous NaOH (VE sequence). In several cases, the VE sequences were followed by an alkaline hydrogen peroxide stage (P stage) to demonstrate that the polyoxometalate treated pulps are easier to brighten than the control pulps. In one case, a VEVEP sequence was carried out to demonstrate that the effectiveness of the polyoxometalate treatment can be greatly enhanced by using a repetitive sequence.

General method. Bleaching experiments were carried out as follows: Aqueous polyoxometalate solutions, 0.01 to 0.10 M, were prepared. The pH of each solution was adjusted to 1.5 to 2.5. Mixed pine Kraft pulp (kappa number=33) was then added to the polyoxometalate solution to a consistency of approximately 3.0% and the mixtures heated at 100° C. for four hours in a sealed vessel (V stage). In some cases the reactions were run anaerobically, under nitrogen.

After exposure to the pulp, the polyoxometalate solutions were then collected, and several aliquots were titrated with ceric ammonium sulfate to determine the extent of polyoxometalate reduction. A color change in the solution, from red or orange to dark brown, green or blue, also indicates reduction of the polyoxometalates. The bulk of the polyoxometalate solutions were then reoxidized with air, dioxygen, hydrogen peroxide and other organic or inorganic peroxides (free acid or salt forms), or ozone.

The pulps were washed with water and extracted for one to three hours at 60°-85° C. in 1.0% NaOH (E stage). In some cases, this cycle was repeated in a VEVE sequence, followed by an alkaline hydrogen peroxide (P) stage.

After each stage, the pulps were analyzed for lignin content both spectroscopically (Uv-vis and FT Raman spectroscopy) and chemically (kappa numbers). Fiber damage was monitored by measuring the viscosities of pulp solutions according to TAPPI methods. Technidyne brightnesses were obtained according to TAPPI methods. Reoxidation of the reduced polyoxometalates by air, hydrogen peroxide, peroxyacids and ozone was monitored by Uv-vis spectroscopy, and the integrity of the material in the reoxidized polyoxometalate solutions was confirmed by $^{31}P$ NMR spectroscopy.

Control experiments were carried out using identical conditions in parallel sequences, but with no added polyoxometalates. We call the control version of the V stage, in which no polyoxometalate was added, the Δ stage.

Two spectroscopic techniques, transmission Uv-vis spectroscopy and FT Raman spectroscopy, were used to monitor the removal of lignin-derived material from the chemical pulp upon treatment with the polyoxometalates.

Uv-vis spectroscopy. Uv-vis spectra of the pulp samples exposed to the four different polyoxometalate compounds were obtained after each stage V, VE and VEP, and after the control sequences Δ, ΔE and ΔEP. For each spectrum, approximately 10 mg of oven dried pulp was dissolved slowly in 85% phosphoric acid at room temperature. Uv-vis spectra of the resultant solutions were obtained using a Perkin Elmer Lambda 6 spectrophotometer, and displayed as plots of extinction coefficients (E in units of L/g-cm) vs wavelengths (λ), from 600 to 190 nm. Since cellulose is transparent over this frequency range, we attribute the observed absorption to conjugated structures associated with residual lignin. Thus, as residual lignin is removed from the pulp the area under the curve decreases. The spectra are displayed as comparisons of polyoxometalate treated pulps and control pulps at specified stages of the bleaching sequence. Sets of spectra were obtained for each of the bleaching Examples 1-5 and are presented at FIGS. 2-8.

FT Raman spectroscopy. FT Raman spectra were obtained from solid pulp samples after each stage V, VE and VEP, and after the control sequences Δ, ΔE and ΔEP, for a bleaching experiment using $H_5[PV_2Mo_{10}O_{40}]$ (compound 1), carried out as described in Example 1 (VEP sequence; 40% $H_2O_2$O.D. pulp in the P stage). Raman spectra of pulp samples were recorded using a Nicolet 910 Raman instrument, using a 180° reflective sample geometry. The spectrometer was a dedicated near infra-red FT Raman bench using the 1064-nm line from a $Nd^{3+}$: YAG laser for excitation.

Kappa numbers and brightnesses. Kappa numbers, obtained by permanganate oxidation of residual lignin, are an index of how much lignin is present within a wood or pulp sample. Although difficult to measure accurately or to interpret when only small amounts of lignin are present, kappa numbers are a widely used and easily recognized index of lignin content. Kappa numbers were obtained using TAPPI methods T236 om-85 and um-246.

Brightnesses are a measure of how much light is reflected from a sheet of paper made from a specific pulp sample. Higher numbers mean that more light is reflected. To the eye, brightness corresponds to a whiter sheet of paper. The untreated Kraft pulp used in this work has a brightness of 25.4%. Fully bleached commercial pulps can have brightnesses as high as 90%. The ultimate goal of bleaching is simply to achieve high brightness with minimal fiber damage. Handsheets for brightness tests were prepared by adaptation of TAPPI method T218 om-83. Brightnesses were obtained from single handsheets using a Technidyne instrument.

EXAMPLE 1

$H_5[PV_2Mo_{10}O_{40}]$(compound 1); VEP Sequence 2.0 g oven-dried (O.D.) weight of mixed pine Kraft pulp was added to a 0.100M solution of compound 1, adjusted to a pH of 1.45 by addition of 1N NaOH, to a final consistency of 3.0% in a 100 mL round-bottomed flask. The pH of the mixture was 1.54. The flask was sealed in air and heated in a 100° C. bath for four hours. During heating, the solution changed from orange to dark green-brown.

The pulp, now somewhat darker and slightly reddish-brown in color, was collected on a Büchner funnel and the partially reduced polyoxometalate solution (pH=1.98) was saved.

The partially reduced polyoxometalate solution was titrated to an orange endpoint with ceric ammonium sulfate. 3.2% of the vanadium(V) present, or $2.07\times10^{-4}$ mol of vanadium(V) per 1.0 g O.D. pulp, had been reduced to vanadium(IV).

The pulp was washed three times with water and heated for three hours at 85° C. in 1.0% aqueous NaOH at a consistency of 3.2% in an open round-bottomed flask. At the end of this time the alkali solution was brown, and the pulp had lost some of its dark reddish color. After collecting and washing with water, the pulp was treated with 40% $H_2O_2$ (relative to the O.D. weight of the pulp) at a consistency of 2.0% for 1.5 hours at 85° C. and an initial pH of 10.42.

A control experiment was performed in parallel under identical conditions, but without added polyoxometalates. In the control, no darkening of the pulp occurred in the first stage (Δ) and little color was observed in the aqueous NaOH solution after the E stage.

Prior to reuse of the polyoxometalate solution, air was bubbled gently through the polyoxometalate solution for 1.5 hours at 60° C., and the pH of the solution was then adjusted to 1.5 with concentrated $H_2SO_4$. The reoxidation was monitored spectrophotometrically (see Example 11). After reoxidation, the $^{31}P$ NMR spectrum of the reoxidized polyoxometalate solution was obtained. No phosphorus-containing decomposition products were observed.

Table 1 describes kappa number and brightness measurements for the V stage, E stage and P stage of Example 1. The kappa number, indicating the amount of lignin present, is lower in the V and VE measurements as opposed to the Δ and ΔE measurements. Significant delignification is evident after the E stage in the polyoxometalate treated pulp, while brightening does not occur until the P stage.

An asterisk in Table 1 or any of the following tables indicates that a value is too low to be determined accurately.

TABLE I

| | Kappa No. | Brightness | | Kappa No. | Brightness |
|---|---|---|---|---|---|
| V | 19.2 | 19.1 | Δ | 24.7 | 31.7 |
| E | 10.7 | 26.7 | E | 18.9 | 33.5 |
| P | (1.7)* | 71.2 | P | 7.2 | 55.9 |

Pulp viscosity (η) is a measurement of the extent to which cellulose fibers have been damaged during bleaching. Before bleaching, the mixed pine kraft pulp had a viscosity in solution with cupric sulfate and ethylene diamine (according to TAPPI methods) of 30 mPa-sec$^{-1}$. To determine the viscosity of the pulp after the V and Δ stages, compound 1 was used as described above, but with careful exclusion of dioxygen during the V stage. Pulp viscosities, measured after V and Δ, and after VE and ΔE are tabulated below in Table 2.

In the present invention, the efficacy of the polyoxometalate compounds 1–4, was demonstrated at low pH values of 1.5 to 2.5. After heating at these pH values for four hours at 100° C., substantial acid-catalyzed degradation of the cellulose fibers occurs. As a result of the low pH values used in the examples, pulp viscosities are all lower than they would have been if the reactions were done at higher pH values. Many polyoxometalates are stable at higher pH values. For example, compound 3 is stable when heated for four hours at 100° C. at a pH of 4 (I.A. Weinstock, unpublished results) and materials closely related to compound 2, e.g., $Na_xH_{6-x}[PW_9V_3O_{40}]$, are stable at pH values as high as 8 (Kuznetsova, L.I., et al., *Inorganica Chimica Acta*, 167, 223–231, 1990). However, the stability of 1 at higher pH values has not been firmly established. In order to demonstrate the efficacy of compounds 1–4, as bleaching agents, as quickly as possible, we chose a low pH at which all of the materials are stable at elevated temperatures.

Therefore, although the viscosities reported here are low, the relatively small differences between the polyoxometalate-treated pulps and the control pulps heated at the same pH, but with no added polyoxometalates suggest that when run at higher pH values, the polyoxometalate-treated pulps should meet industry standards.

TABLE 2

| | η | | η | |
|---|---|---|---|---|
| V | 6.52 | Δ | 11.04 | $\eta_{(\Delta-V)} = 4.52$ |
| E | 6.58 | E | 12.03 | $\eta_{(\Delta-V)} = 5.45$ |

Figure 2A:
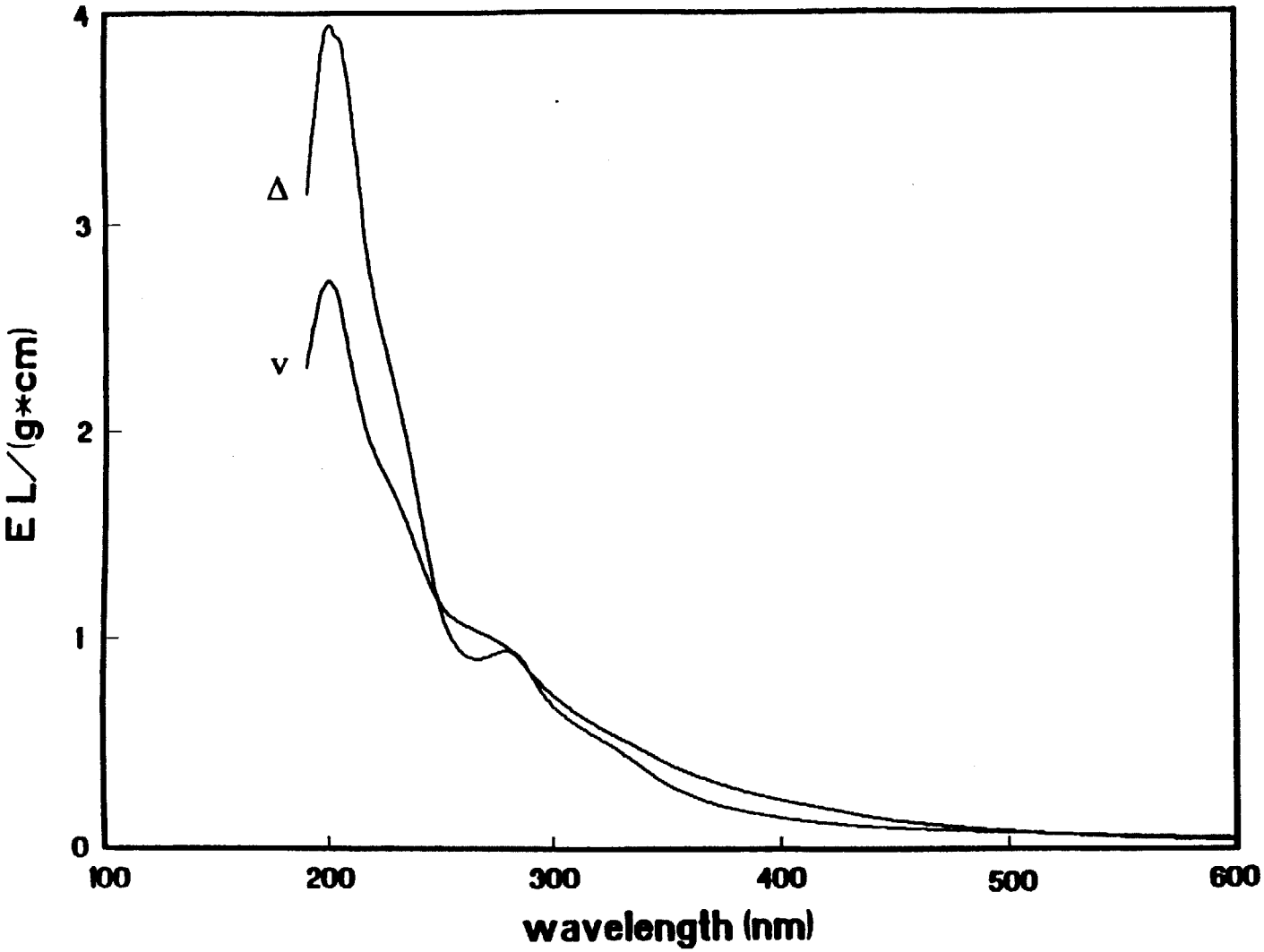
FIG. 2*a* is a plot of E vs λ for pulps obtained after stages V and Δ in Example 1.
Figure 2B:
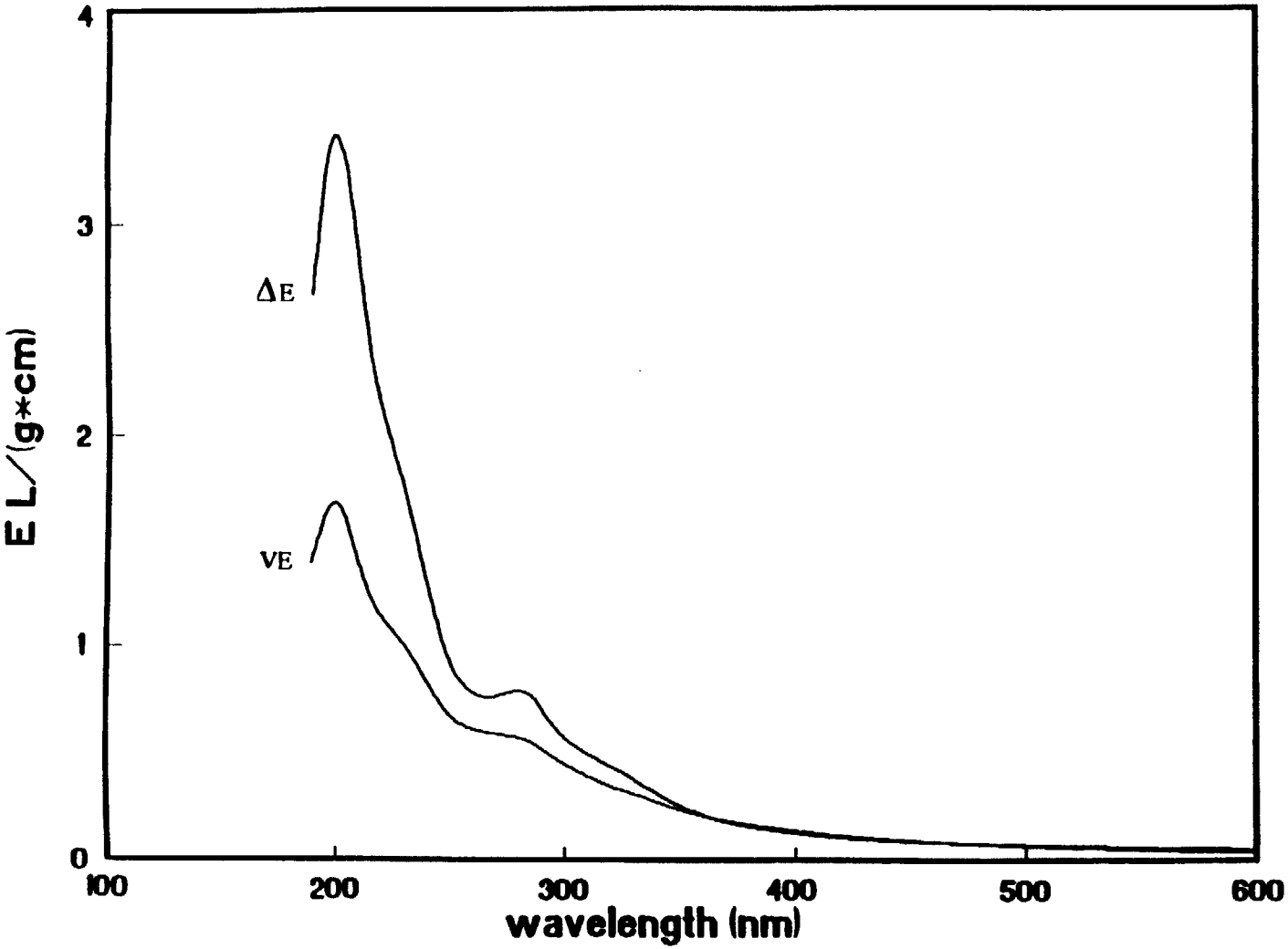
FIG. 2*b* is a plot of E vs λ for pulps obtained after stages VE and ΔE in Example 1.
Figure 2C:
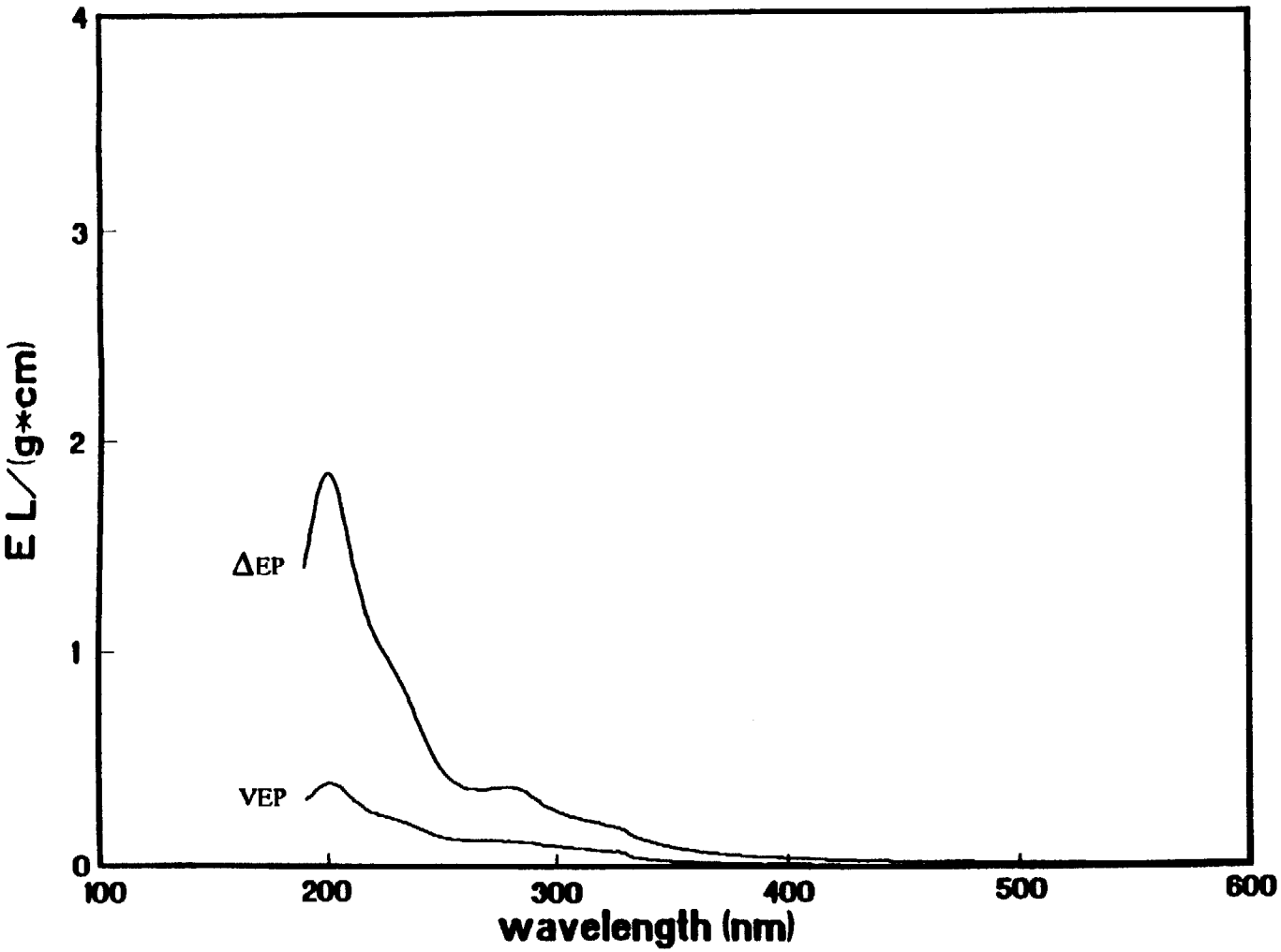
FIG. 2*c* is a plot of E versus λ for pulps obtained after stages VEP and ΔEP in Example 1. In the P stage, 40% $H_2O_2$/O.D. pulp was used.
Figure 3:
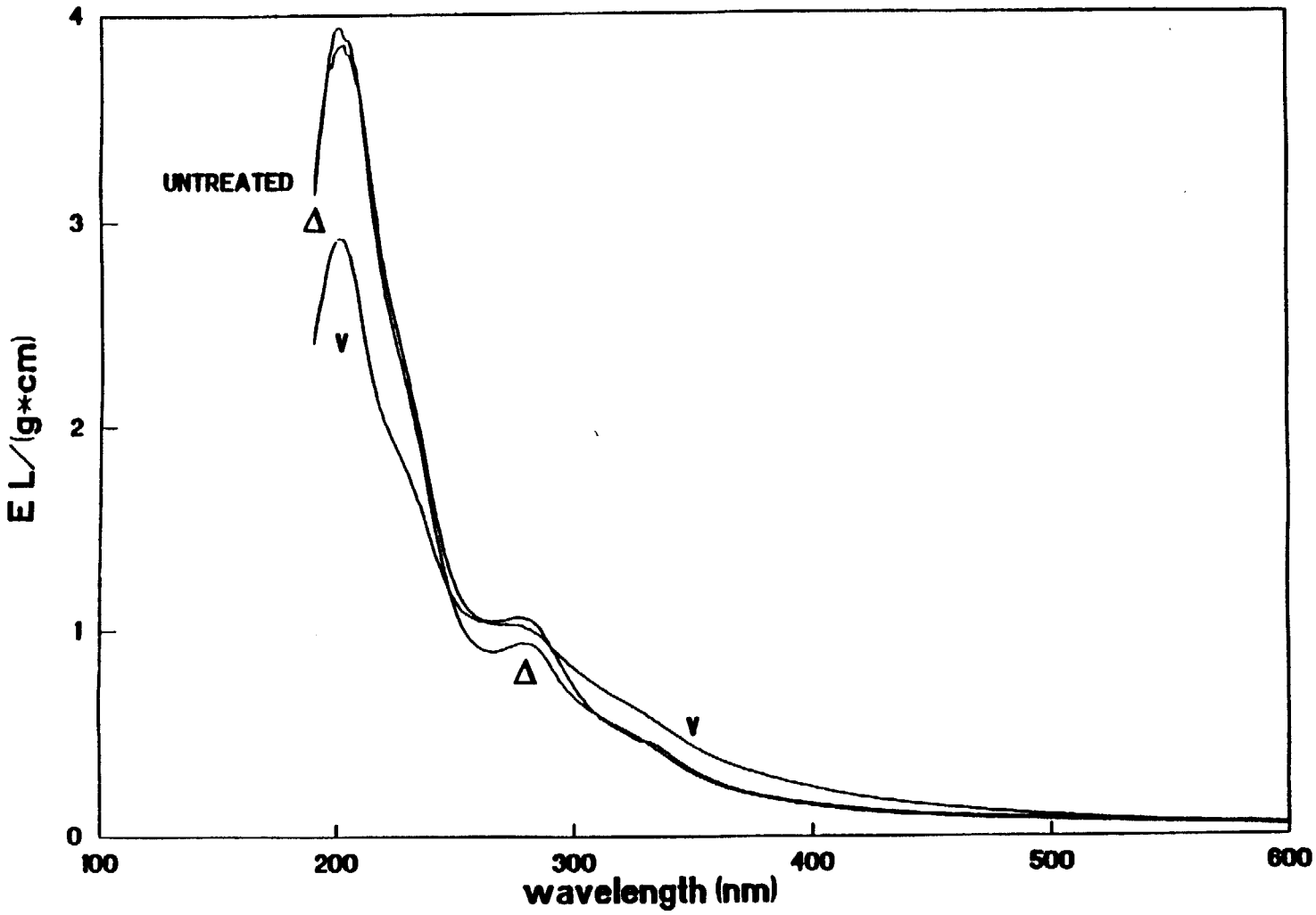
FIG. 3 is a comparison of untreated Kraft pulp with pulps obtained after V and Δ (FIG. 2*a*.).

FIGS. 2*a*, 2*b*, 2*c* and 3 illustrate spectrophotometric differences in pulps treated with compound 1. FIG. 2*a* is a plot of E versus λ for pulps obtained after stages V and Δ. FIG. 2*b* is a plot of E versus λ for pulps obtained after stages VE and ΔE. FIG. 2*c* is a plot of E versus λ for VEP and ΔEP pulps. FIG. 3 is a comparison of untreated Kraft pulps with these V stage and Δ stage pulps. The P stage for the plots of FIG. 2 involved 40% $H_2O_2$ per O.D. pulp.

FIG. 2*a* and FIG. 2*b* indicate that there is less lignin present in the V stage than in the Δ stage and that there is less lignin present in the VE and VEP stage than there is in the ΔE and ΔEP stage. FIG. 3 indicates that significant decreases in residual lignin are not observed after the V stage alone.

EXAMPLE 2

$H_5[PV_2Mo_{10}O_{40}]$ Compound 1); VEVEP Sequence

Compound 1 was used in a $V_1EV_2EP$ sequence, with a control sequence denoted $\Delta_1E\Delta_2EP$. In the first stage, $V_1$, 5.0 g O.D. weight of mixed pine kraft pulp was added to a 0.100M solution of compound 1 to a final consistency of 3.0% in a 500 mL round-bottomed flask. The pH of the mixture was 1.52. The flask was sealed in air and heated in a 100° C. bath for four hours.

At the end of the reaction, the pH of the solution was 1.70 and 3.13% of the vanadium(V) present, or $2.03\times10^{-4}$ mol of vanadium(V) per 1.0 g O.D. pulp, had been reduced. Extractions were carried out in 1.0% NaOH as described above. After the second V stage, $V_2$ (1.0 g oven dried weight of the $V_1E$ treated pulp at a consistency of 1.0% in a 0.03M solution of compound 1 at a pH of 1.50), $4.38\times10^{-5}$ mol of V(V) per 1.0 g O.D. pulp were reduced. After a second extraction stage, the pulp was treated with 10% $H_2O_2$, relative to the O.D. weight of the pulp, at a consistency of 2.0% for 1.5 hours at 85° C. and an initial pH of 11.19. The control sequence, $\Delta_1E\Delta_2EP$, was carried out in parallel with no added polyoxometalates.

Table 3 describes the kappa number and brightness measurements for the different stages in the above-described experiment. Kappa numbers are less at every stage of the polyoxometalate-exposed pulp than the control pulp. In particular, the effect of repeating the VE sequence is shown by the large differences in kappa numbers measured after $V_1EV_2E$ and $\Delta_1E\Delta_2E$. Note that, due to repetition of VE, only 10% $H_2O_2$ per O.D. pulp is needed to dramatically improve the brightness of the polyoxometalate treated pulp relative to that of the control.

TABLE 3

| | Kappa No. | Brightness | | Kappa No. | Brightness |
|---|---|---|---|---|---|
| $V_1$ | 19.2 | 19.1 | $\Delta_1$ | 24.7 | 31.7 |
| E | 10.7 | 26.7 | E | 18.9 | 33.5 |
| $V_2$ | — | — | $\Delta_1$ | — | — |
| E | 5.2 | — | E | 17.1 | — |
| P | (1.4)* | 68.3 | P | 9.9 | 50.0 |

Values for $V_1$, $V_1E$, $\Delta_1$ and $\Delta_1E$ have been carried over from Example 1.

Figure 4:
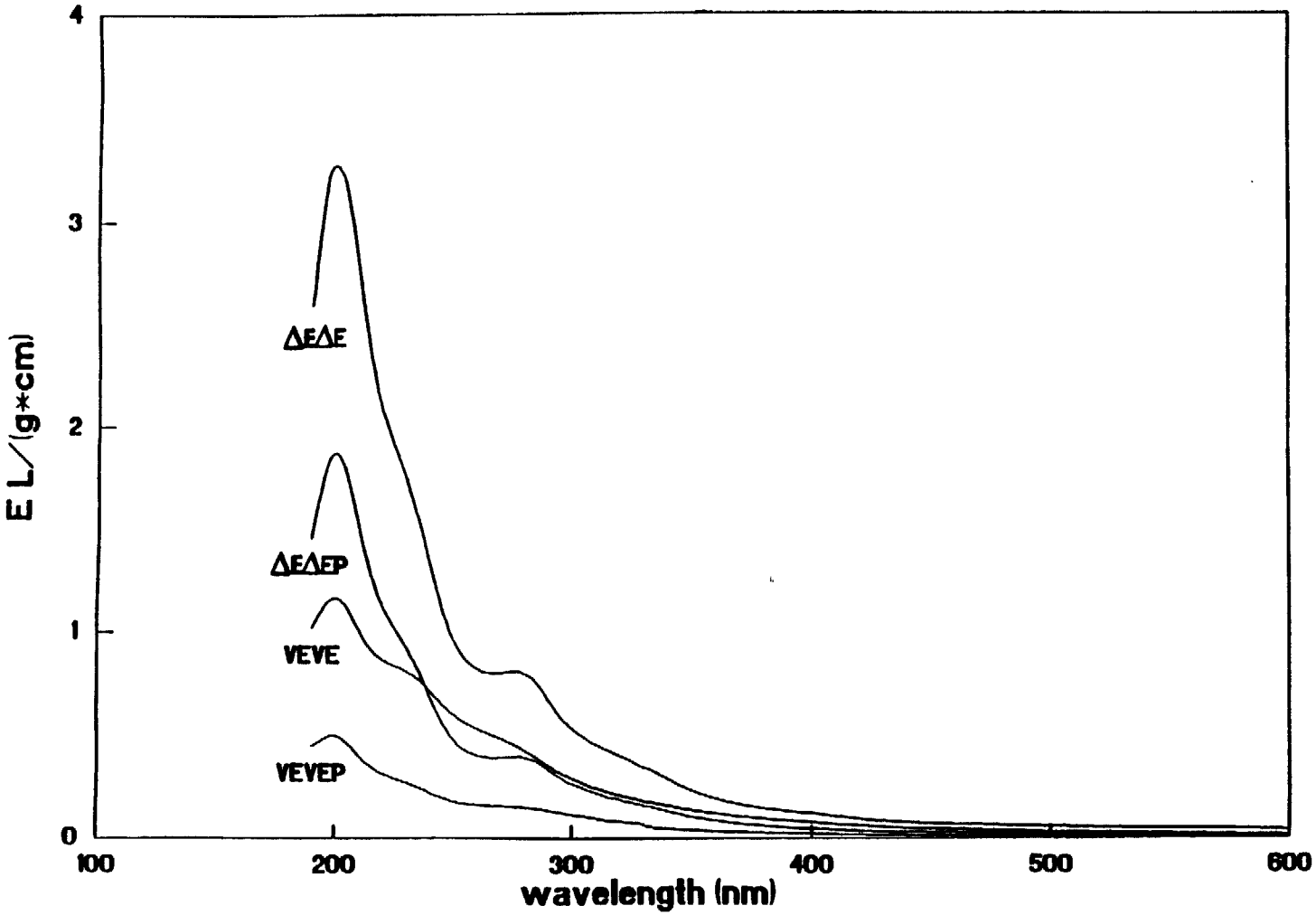
FIG. 4 is a plot of E vs λ for pulps obtained after stages VEVE, ΔEΔE, VEVEP and ΔEΔEP in Example 2. In the P stage, 10% $H_2O_2$/O.D. pulp is used.

FIG. 4 is a plot of E versus λ for the VEVE stage versus the ΔEΔE stage and the VEVEP stage versus the ΔEΔEP stage. The plot indicates that there is less lignin present in the polyoxometalate-exposed pulps.

Figure 5:
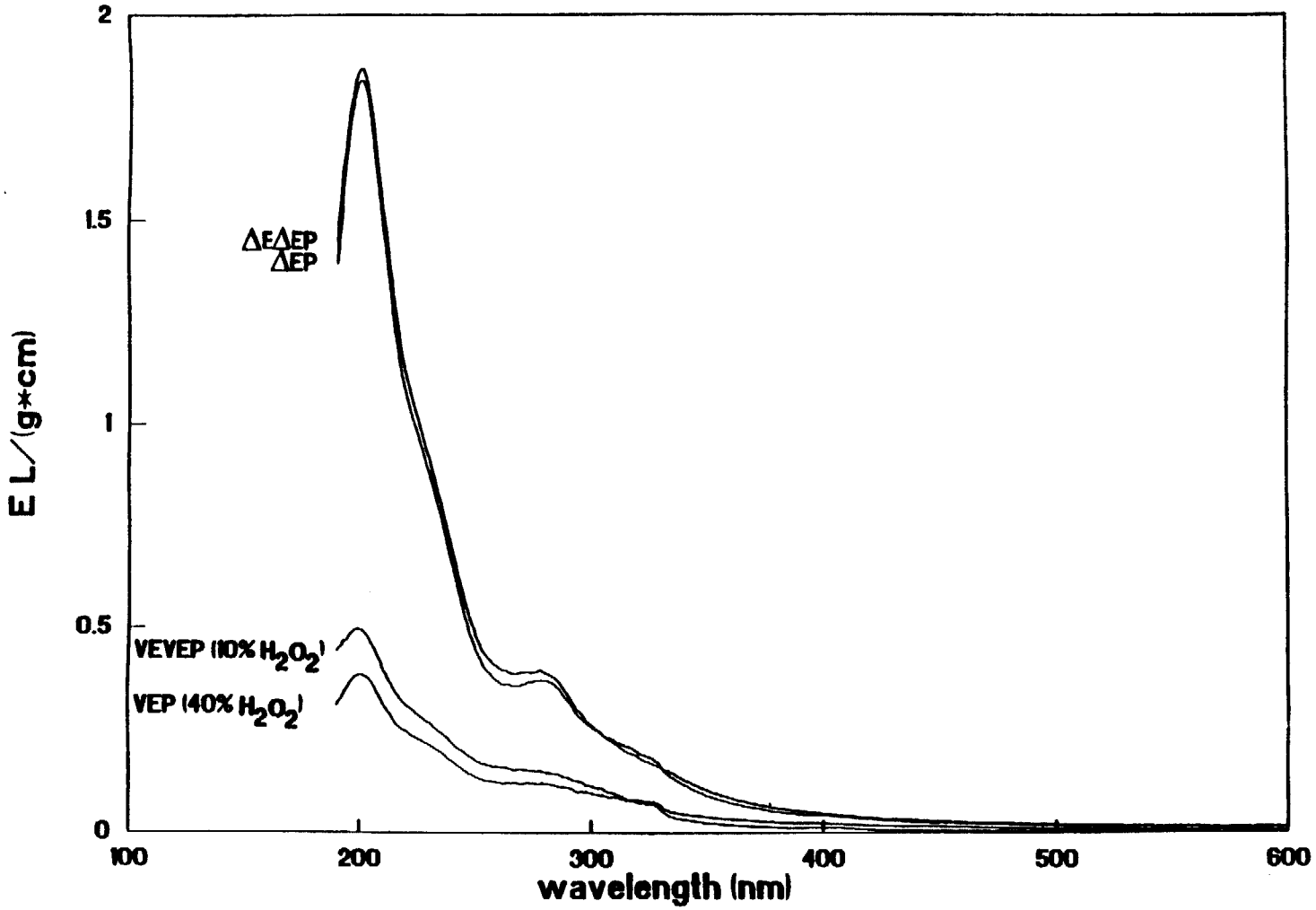
FIG. 5 is a comparison of VEP (40% $H_2O_2$/O.D. pulp in P) and VEVEP (10% $H_2O_2$/O.D. pulp in P) with ΔEP (40% $H_2O_2$/O.D. pulp in P) and ΔEΔEP (10% $H_{22}$/O.D. pulp in P).

FIG. 5 is a comparison of VEP (with 40% $H_2O_2$/O.D. pulp in the P stage) and VEVEP (with 10% $H_2O_2$/O.D. pulp in the P stage) with ΔEP (40% $H_2O_2$/O.D. pulp in P) and ΔEΔEP (with 10% $H_2O_2$/O.D. pulp in the P stage). FIG. 5 indicates that 10% $H_2O_2$/O.D. pulp in the P stage, after the repetitive sequence VEVE gives a result similar to that obtained using 40% $H_2O_2O$/D. pulp after a single VE sequence.

EXAMPLE 3

$Na_4[PVW_{11}O_{40}]$ (Compound 2); VEP Sequence 1.0 g O.D. weight of mixed pine kraft pulp was added to a 0.09M solution of compound 2 to a final consistency of 3.0% in a 100 mL round-bottomed flask. The pH of the mixture was adjusted to 1.50 with concentrated $H_2SO_4$. The flask was sealed in air and heated in a 100° C. bath for four hours. During heating, the solution changed from orange to greenish-brown. The pulp, now somewhat lighter in color, was collected on a Bûchner funnel and the partially reduced polyoxometalate solution (pH=1.67) was saved. 43.6% of the vanadium(V) present, or $1.27\times10^{-3}$ mol vanadium(V) per 1.0 g O.D. pulp, had been reduced to vanadium(IV).

The pulp was washed three times with water and heated for three hours at 85° C. in 1.0% aqueous NaOH at a consistency of 3.2% in an open round-bottomed flask. At the end of this time the alkali solution was brown, and the pulp was lighter in color. After collecting and washing with water, the pulp was treated with 40% $H_2O_2$ (relative to the O.D. weight of the pulp) at a consistency of 2.0% for 1.5 hours at 85° C. and an initial pH of 10.48.

The reduced polyoxometalates in the solution of compound 2 were reoxidized by addition of oxone (potassium monopersulfate compound) (30 mg/mL polyoxometalate solution) and heating to 100° C. for 10 minutes. The reoxidation was monitored spectrophotometrically and the $^{31}P$ NMR spectrum of the reoxidized polyoxometalate solution was obtained (see Example 12). Phosphorus-containing products of rearrangement or isomerization were observed at concentrations of less than approximately 5.0%. No phosphorous-containing decomposition products were observed.

Table 4 describes the kappa number and brightness measurements for the different stages of the above-described experiment. Notably, the kappa number after VE is dramatically lower than that after ΔE and is too low to measure accurately after the P stage in the VEP sequence. Once again, the brightness measurement indicates that the polyoxometalate treated pulp is easier to brighten than the control pulp.

TABLE 4

| | Kappa No. | Brightness | | Kappa No. | Brightness |
|---|---|---|---|---|---|
| V | — | — | Δ | 24.7 | 31.7 |
| E | 7.6 | — | E | 18.9 | 33.5 |
| P | • | 67.8 | P | 7.2 | 55.9 |

Figure 6A:
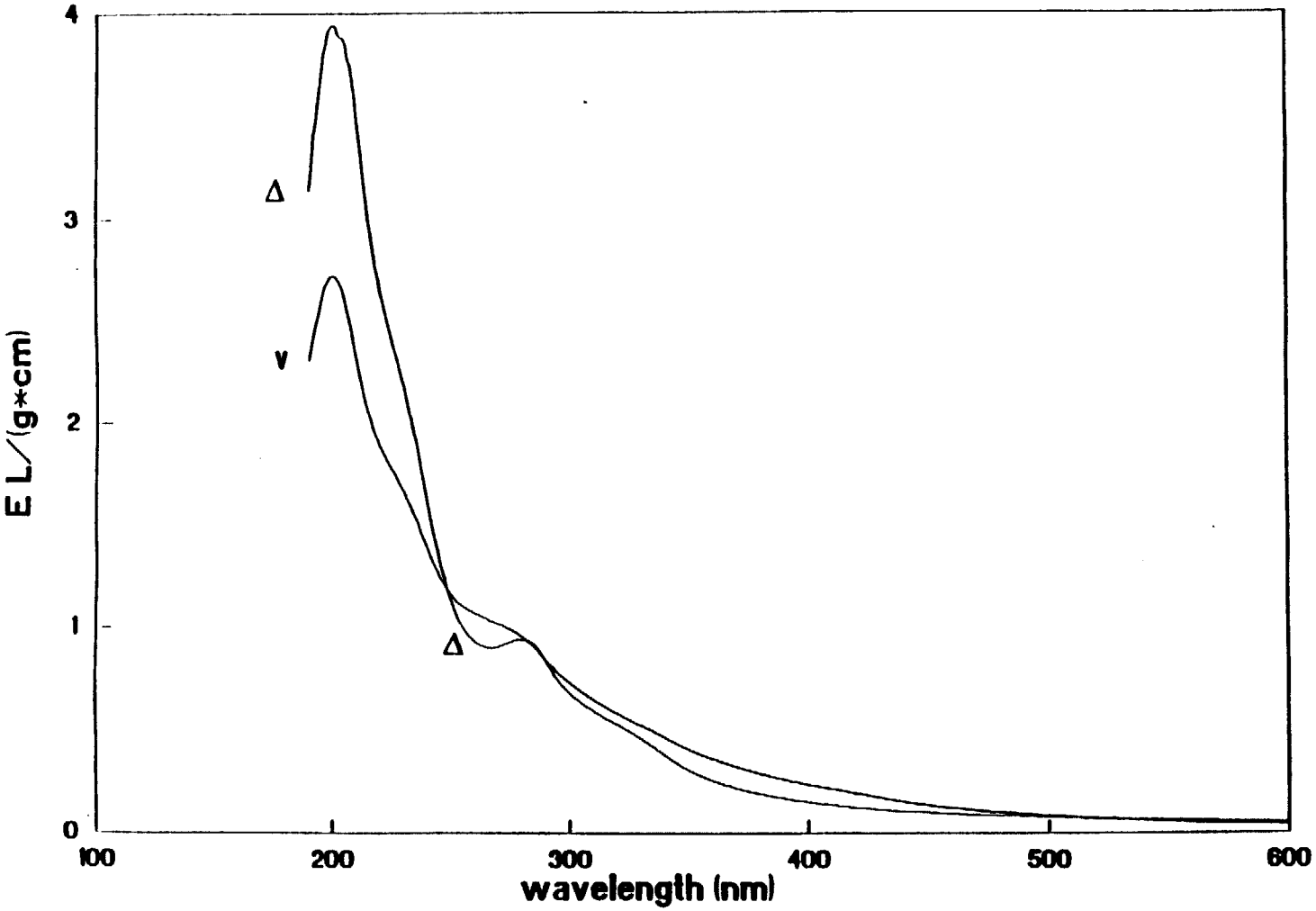
FIG. 6*a* is a plot of E vs λ for pulps obtained after stages V and Δ in Example 3.
Figure 6B:
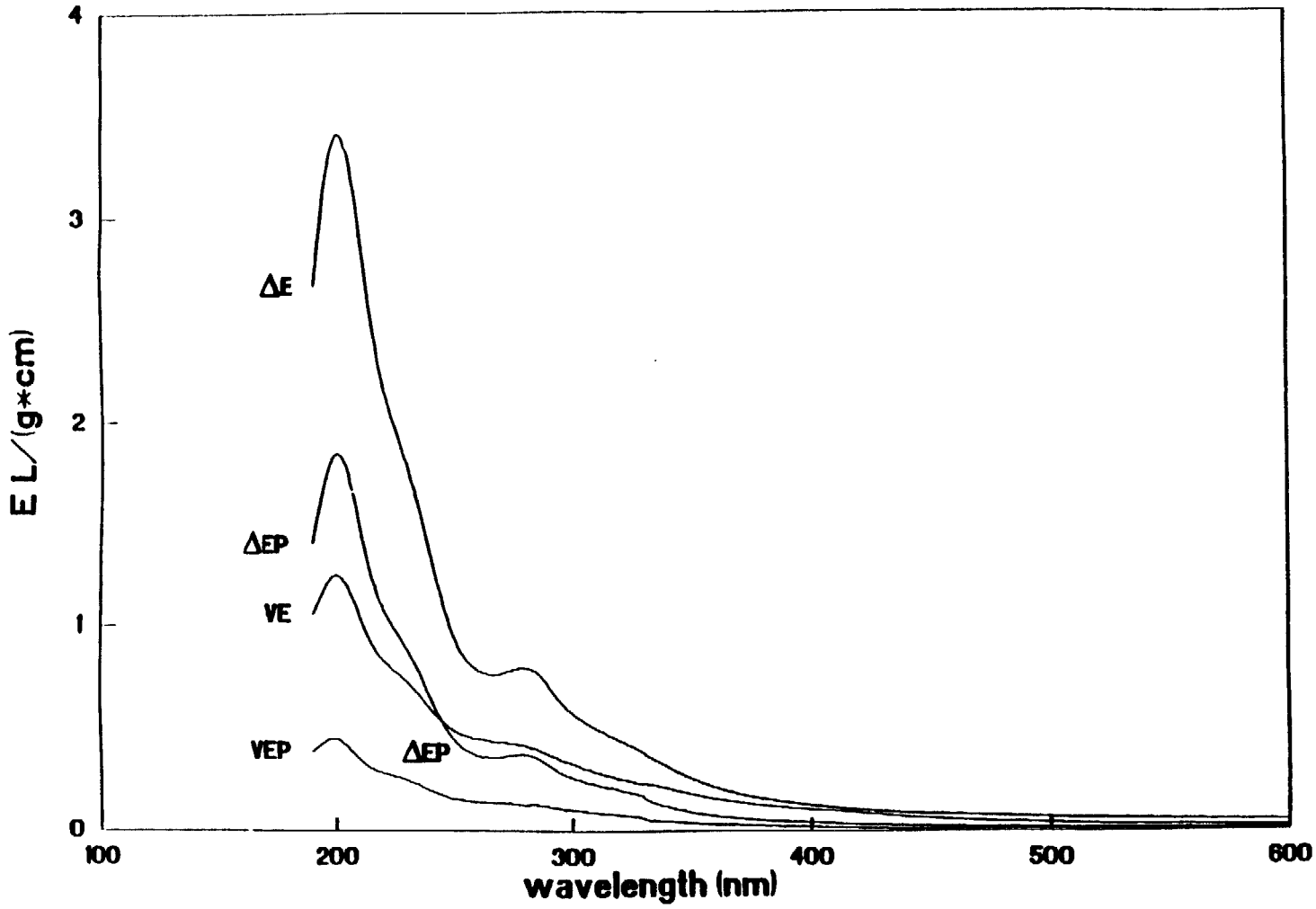
FIG. 6*b* is a plot of E vs λ for pulps obtained after stages VE, ΔE, VEP and ΔEP in Example 3. In the P stage, 40% $H_2O_2$/O.D. pulp was used.

FIGS. 6a and 6b describe spectroscopic measurements for the V and Δ stages (FIG. 6a) and the VE and VEP versus ΔE and ΔEP stages (FIG. 6b). The Figures indicate that there is less lignin present in the pulp treated with compound 2.

EXAMPLE 4

$H_9[P_2V_3W_{15}O_{62}]$ (Compound 3); VE Sequence 0.10 g. O.D. weight of mixed pine Kraft pulp was added to a 0.10M solution of compound 3 to a final consistency of 2.7% in a 15 mL round-bottomed flask. The pH of the mixture was adjusted to 1.50 with concentrated $H_2SO_4$. Air was removed in three freeze-pump-thaw cycles, and the flask was sealed under purified nitrogen and heated in a 100° C. bath for four hours. During heating, the solution changed from red-orange to dark orange brown. The pulp, slightly changed in color, was collected on a Bûchner funnel and the partially reduced polyoxometalate solution (pH=2.05) was saved. 5.33% of the vanadium(V) present, or $2.29\times10^{-4}$ mol vanadium(V) per 1.0 g O.D. pulp, had been reduced to vanadium(IV).

The pulp was washed three times with water and heated for three hours at 85° C. in 1.0% aqueous NaOH at a consistency of 3.2% in an open flask. At the end of this time the alkali solution was light brown. The reduced polyoxometalates in the solution of compound 3 were reoxidized immediately upon addition of oxone (potassium monopersulfate compound) (11.3 mg/per mL solution) at room temperature. The reoxidation was monitored spectrophotometrically and the $^{31}P$ NMR spectrum of the reoxidized polyoxometalate solution was obtained. Two new signals, estimated at approximately 5.0%, were observed. The new signals may be due to positional isomers of compound 3, but this has not been established.

Figure 7A:
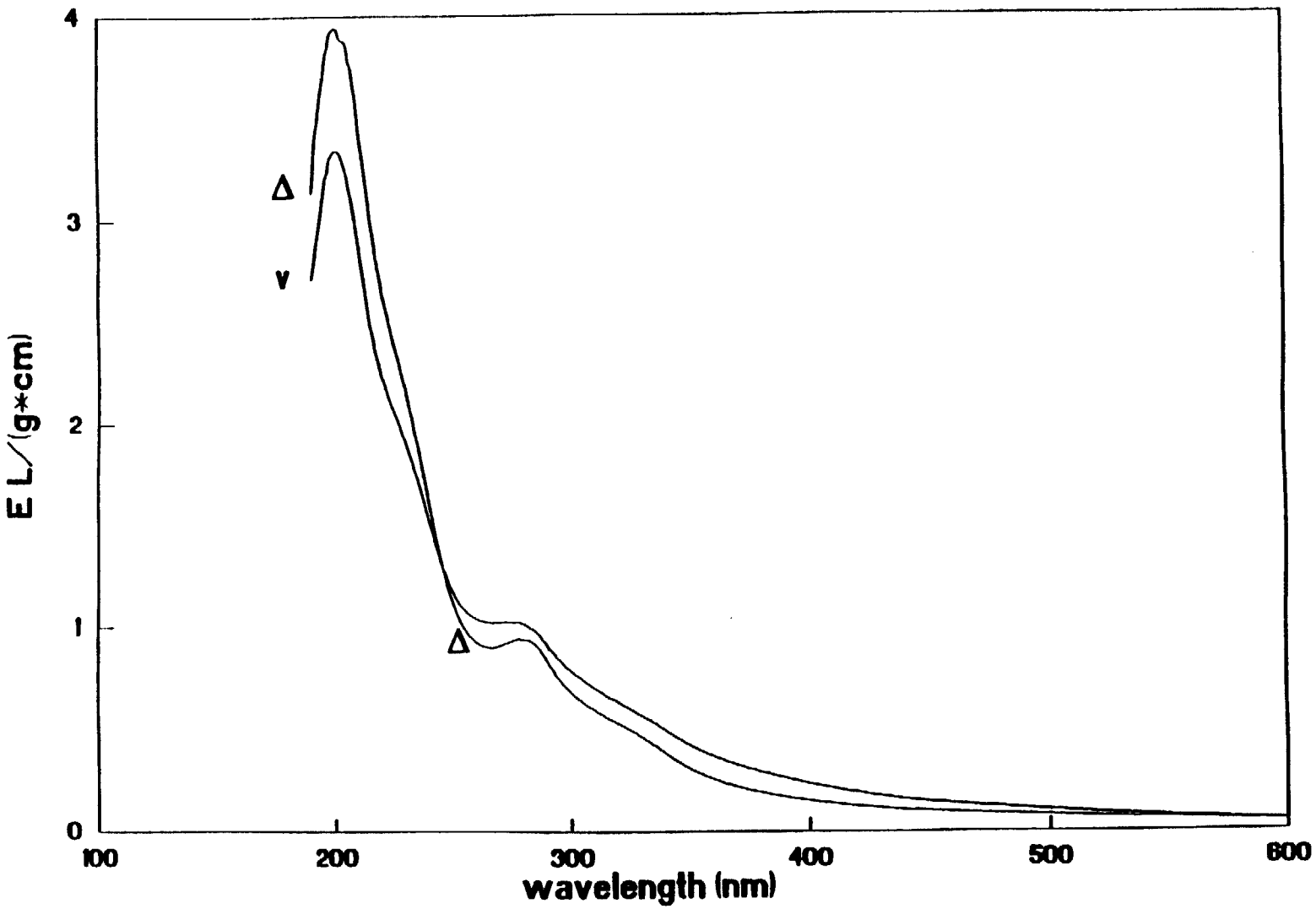
FIG. 7*a* is a plot of E vs λ for pulps obtained after stages V and Δ in Example 4.
Figure 7B:
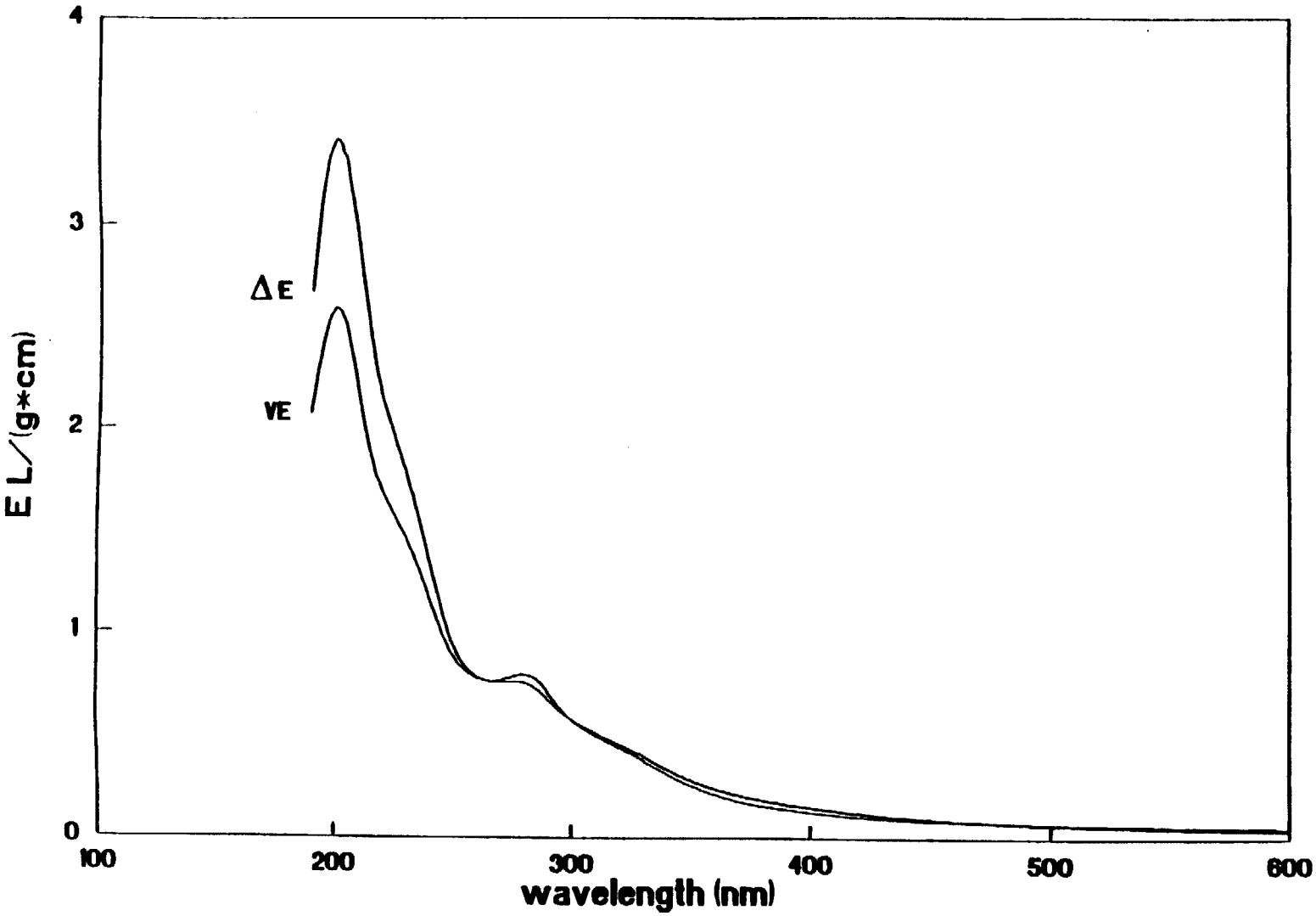
FIG. 7*b* is a plot of E vs λ for pulps obtained after stages VE and ΔE is Example 4.

FIGS. 7a and 7b are plots of E versus λ for the V and Δ stages (FIG. 7a) and the VE and ΔE stages (FIG. 7b).

EXAMPLE 5

$Na_6[V_{10}O_{28}]$ (Compound 4); VE Sequence 0.10 g oven-dried weight of mixed pine Kraft pulp were added to a 0.10M solution of compound 4 to a final consistency of 2.7% in a 15 mL round-bottomed flask. The pH of the mixture was adjusted to 2.5 with concentrated $H_2SO_4$. Air was removed in three freeze-pump-thaw cycles, and the flask was sealed under purified nitrogen and heated in a 100° C. bath for four hours. During heating the solution changed from orange to red-brown and precipitate of the same color fell out of solution. The mixture of pulp and precipitate was collected on a Bûchner funnel and washed with water. Little if any of the precipitate dissolved. The pulp was soaked for 3 hours at room temperature in 1N NaOH to dissolve the precipitated vanadates, washed with water, and extracted for three hours at 85° C. in 1.0% aqueous NaOH. The extract was light brown in color.

Figure 8:
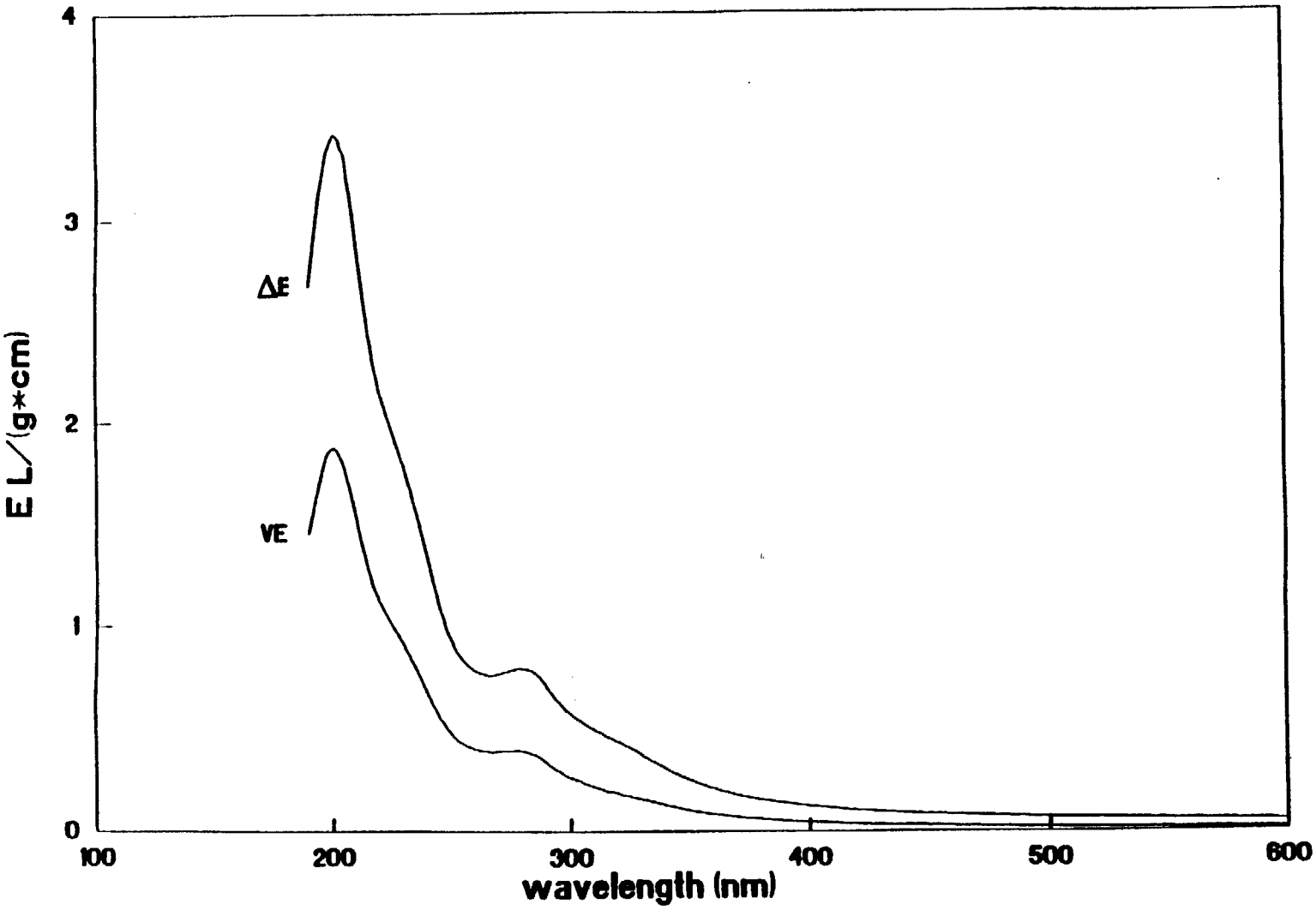
FIG. 8 is a plot of E vs λ for pulps obtained after stages VE and ΔE in Example 5.
Figure 9A:
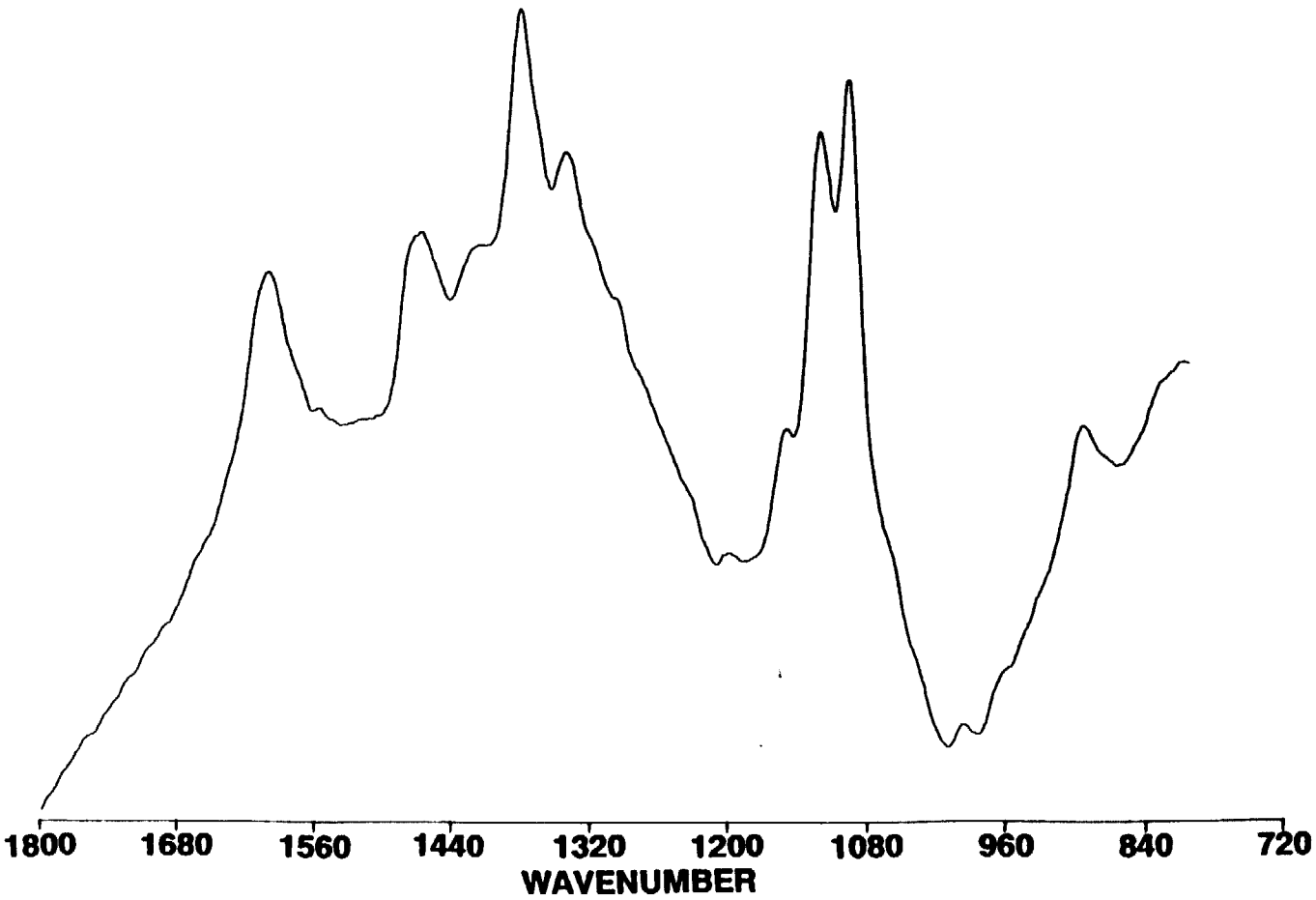
FIG. 9*a* is an FT Raman plot of untreated mixed pine Kraft pulp.
Figure 9B:
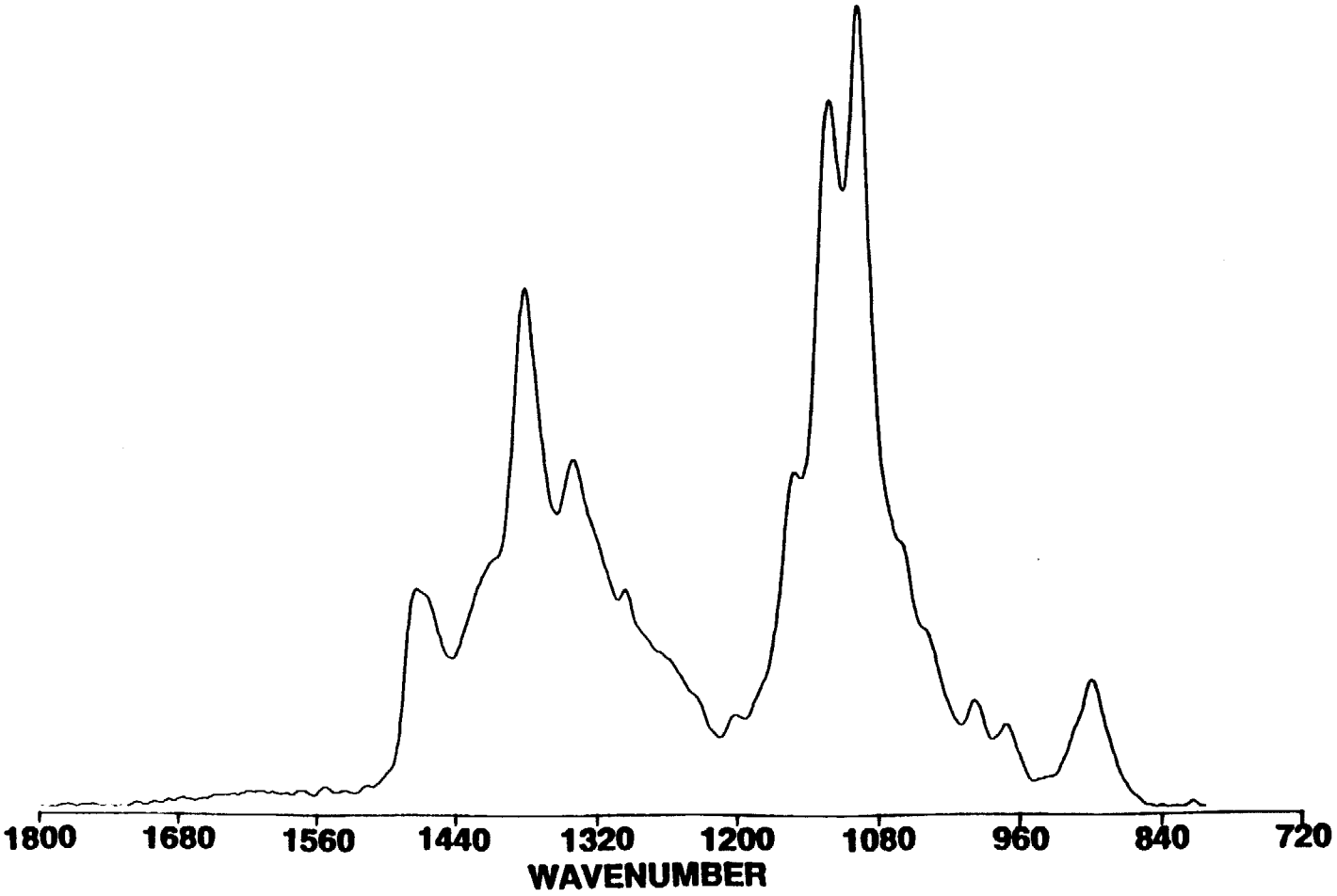
FIG. 9*b* is an FT Raman plot of commercially bleached softwood Kraft pulp.
Figure 9C:
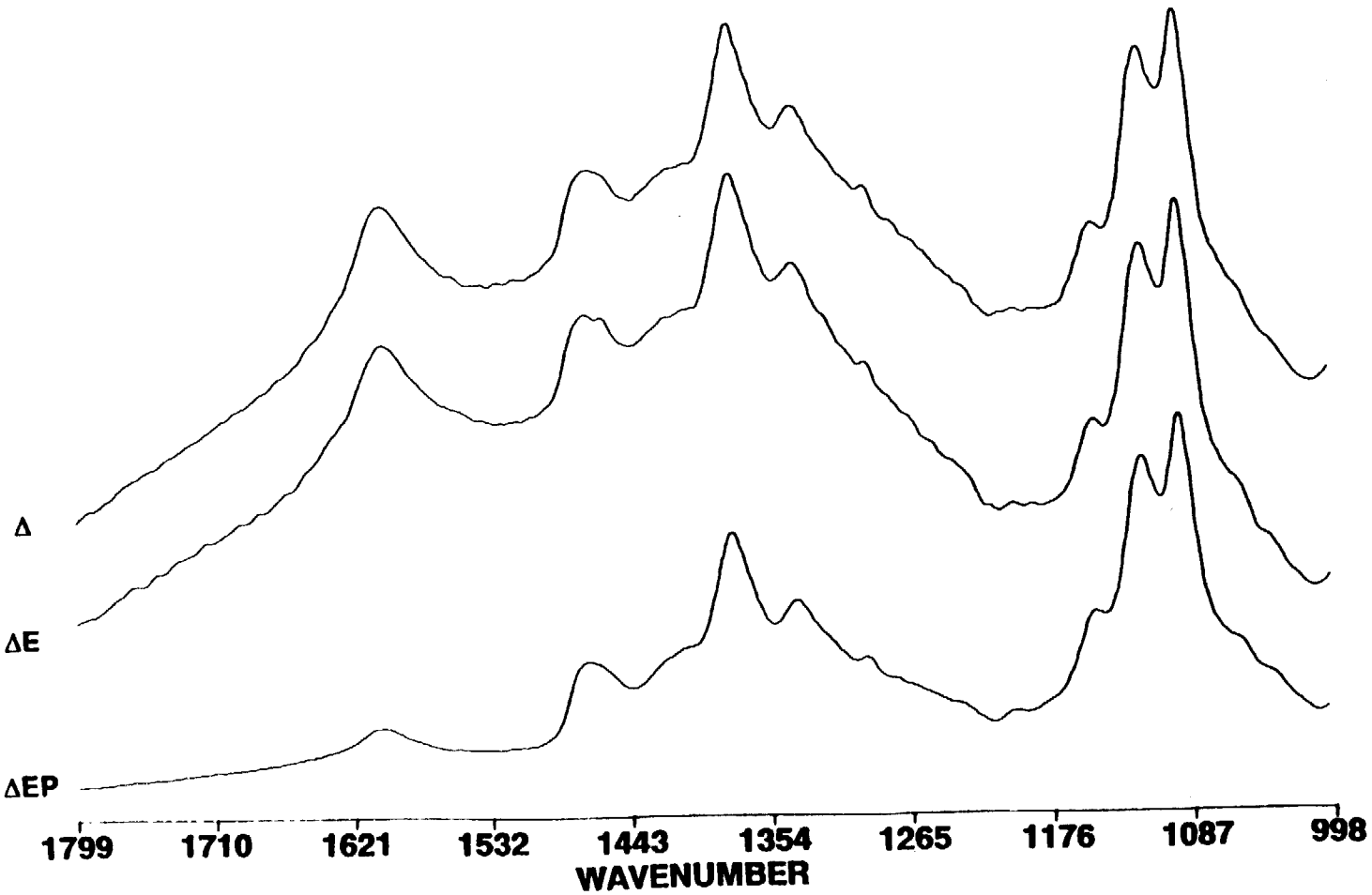
FIG. 9*c* is an FT Raman plot of pulps obtained after each stage of a ΔEP control sequence (no polyoxometalates). Spectra were obtained after Δ, ΔE and ΔEP stages of Example 1.
Figure 9D:
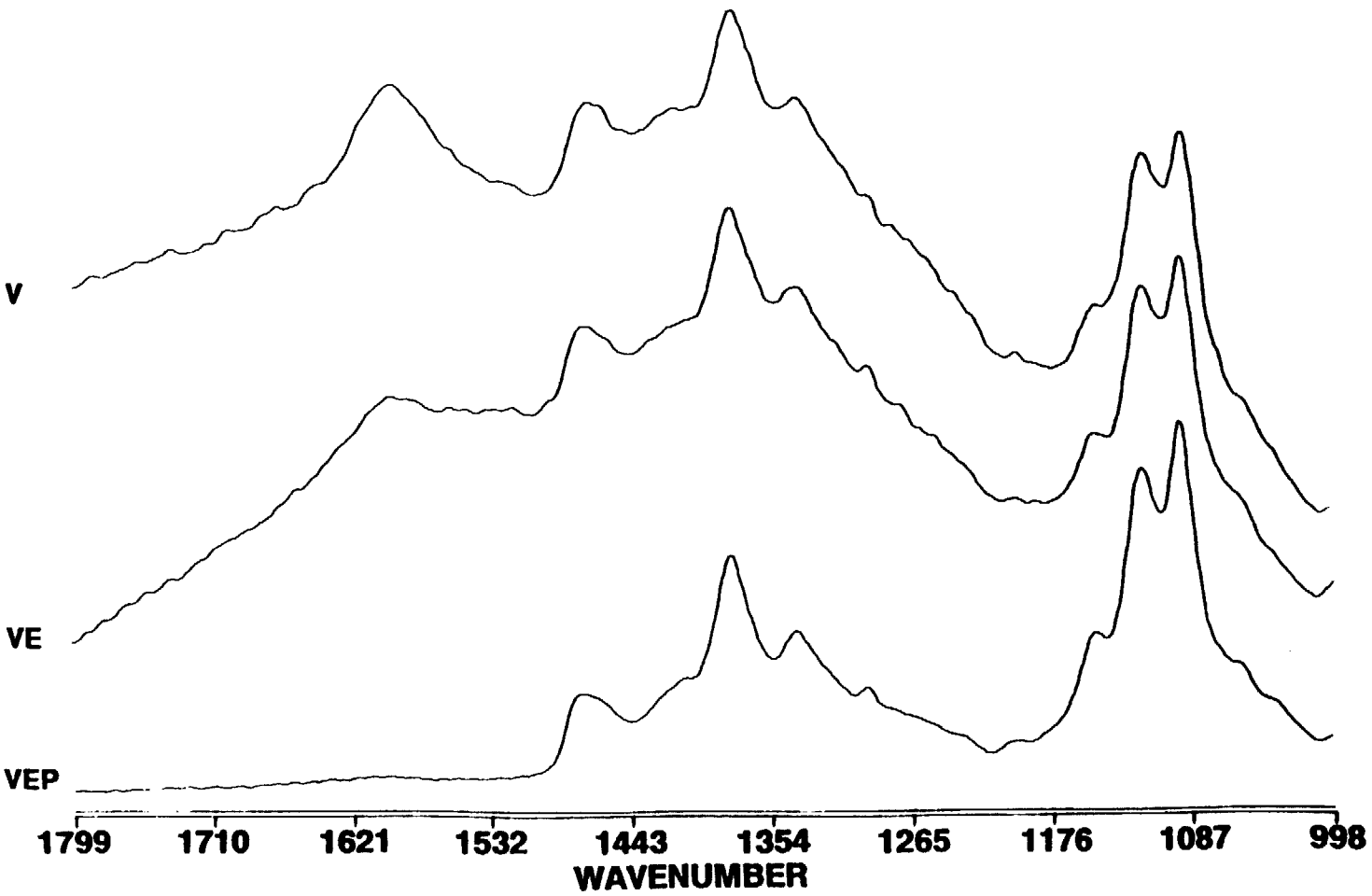
FIG. 9*d* is an FT Raman plot of pulps obtained after each stage of a VEP sequence. Spectra were obtained after V, VE and VEP stages of Example 1.

FIG. 8 is a plot of E versus λ for pulps obtained after stages VE and ΔE.

Reoxidation Of Used Bleaching Liquors Containing Reduced Polyoxometalates

All of the oxidants mentioned below are thermodynamically capable of reoxidizing all of the reduced polyoxometalates. Nonetheless, differences in rates have been observed, and no clear pattern of reoxidation rates is yet discernible. The most desirable oxidants are probably air, dioxygen, or hydrogen peroxide, with air the most desirable.

EXAMPLE 6

Solutions of $H_5[PV_2Mo_{10}O_{40}]$ (compound 1), partially reduced after reaction with Kraft pulps at elevated temperature, were exposed to air as described in Example 1. Moist air was bubbled gently (approximately 0.1 L/min air) through the dark blue-green polyoxometalate solutions for 1.5 hours at 60° C. During this treatment the blue-green color was discharged to give dark orange solutions that became lighter in color upon treatment with mineral acid. The reoxidation was monitored by Uv-vis spectroscopy and, after reoxidation was complete, $D_2O$ was added and $^{31}P$ NMR spectra of the solutions were obtained. Compound 1 exists as a mixture of positional isomers. Although the distributions of these isomers changed during bleaching and reoxidation, no new signals were observed.

In addition to air, ozone was also used as a reoxidant. The solutions were exposed to a stream of ozone (0.1 L/min of a 3.0% mixture of $O_3$ in $O_2$) at 100° C. for several minutes. The result was identical to that obtained upon prolonged exposure to air.

EXAMPLE 7

Solutions of $Na_4[PVW_{11}O_{40}]$ (compound 2), partially reduced after use in bleaching, were not reoxidized at a convenient rate by air or ozone. However, they were readily reoxidized by incremental addition of oxone (potassium monopersulfate compound, Du Pont) or ammonium persulfate at 100° C. Reoxidation Was monitored by Uv-vis spectroscopy. The integrity of compound 2 was confirmed by $^{31}P$ NMR spectroscopy. Although compound 2 remained largely unchanged, small signals, comprising approximately 5.0% or less of the sample, were observed. These signals have been tentatively assigned to isomers of $Na_5[PV_2W_{10}O_{40}]$, a close relative of compound 2.

EXAMPLE 8

Solutions of $H_9[P_2V_3W_{15}O_{62}]$ (compound 3), partially reduced after use in bleaching, were not reoxidized at a convenient rate by air, but were reoxidized rapidly, at room temperature, by oxone, and within several minutes at 100° C. after incremental addition of 30% hydrogen peroxide. Reoxidation was monitored visually, and indicated by a change in color of the solution from dark orange-brown to bright red-orange. Two new $^{31}P$ NMR signals, mentioned in Example 3, were observed in roughly the same proportions in solutions reoxidized by either oxone or hydrogen peroxide.

EXAMPLE 9

Selectivity of the Vanadium-Substituted Polyoxometalates for Lignin

Example 9(a) Oxidation potentials of the polyoxometalates. The standard electrode potential for the vanadium(V)/vanadium(IV) couple in 1M acid is +1.00 V versus the normal hydrogen electrode (NHE). This should be compared to the standard potentials for one-electron reductions of $\frac{1}{2}N_2O_4$ (+1.07), $1/4O_2$ (+1.23), $ClO_2$ (+1.27 V), $\frac{1}{2}Cl_2$ (+1.36), $\frac{1}{2}H_2O_2$ (+1.78) and $1/2O_3$ (+2.07), all versus NHE. Although the rates of lignin oxidation by these materials depend upon the mechanism(s) of electron transfer operating in each case, the one-electron redox potentials suggest that vanadium(V) containing polyoxometalates may be more selective than many of the above materials, although somewhat less reactive. At the same time, the reduction potentials listed here show that V(IV) are thermodynamically capable of reoxidation by all of the oxidants, including dioxygen and hydrogen peroxide, commonly used in bleaching.

Example 9(b) Oxidation of model compounds as a measure of selectivity. $H_5[PV_2Mo_{10}O_{40}]$ (compound 1, and its sodium salt $Na_5[PV_2Mo_{10}O_{40}]$, oxidize activated phenols to quinones (Lissel, M., et al. *Tet. Lett.;* 33, 1795–1798, 1992) and benzylic alcohols to α-ketones (Neumann, R. et al., *J. Org. Chem.*, 56, 5707–5710, 1991). Both phenols and benzylic alcohols are constituents of lignin. Significantly, primary alcohols (constituents of cellulose) are not oxidized even after 22 hours at 90° C.

In our hands, 2-methoxy-4-methyl phenol and 4-hydroxy-3-methoxybenzyl alcohol (vanillyl alcohol) were readily oxidized by compound 1, and veratryl alcohol was oxidized to veratryl aldehyde in 30 minutes at 100° C. However, after heating a mixture of compound 1 (10.0 mL of a 0.01M solution at pH 1.5) and 0.25 g of cotton cellulose for four hours at 100° C. under anaerobic conditions, only about 0.1% of the polyoxometalate present had been reduced. These results demonstrate that the vanadium-substituted polyoxometalates are highly selective for lignin-derived material, implying that minimal oxidative degradation of cellulosic fibers should occur during the use of these materials in bleaching.

EXAMPLE 10

FT Raman Speetroscopy

FIGS. *9a, 9b, 9c* and *9d* describe results obtained in the FT Raman study of solid pulp samples. FT Raman spectra were obtained from solid pulp samples after each stage V, VE and VEP, and after control sequences Δ, ΔE and ΔEP for a bleaching experiment using compound 1 carried out as described in Example 1. For the VEP sequence, 40% $H_2O_2$ per O.D. pulp was used.

The bands observed in the FT Raman spectra of lignocellulosic materials correspond to both lignin and carbohydrate components of the pulp. The broad band, observed at 1590 $cm^{-1}$ in the present study, is due to the ring-breathing mode of phenyl rings present in the residual lignin. The intensity of this band correlates well with the amount of residual lignin in the sample.

EXAMPLE 11

Uv-vis Spectroscopy of Polyoxometalate Solutions

Upon reduction, solutions containing only fully oxidized vanadium-substituted polyoxometalate solutions darken to blue, green, or brown, depending upon the concentration of polyoxometalate in solution, the percentage of total available vanadium(V) ions that have been reduced, and the nature and composition of the reduced species. Upon reoxidation, the dark color is discharged, and the solution returns to its original color. Reduction and reoxidation of the polyoxometalates was monitored quantitatively by observing characteristic changes in the Uv-vis spectra of the polyoxometalate solutions. For example, the absorbance of the oxidized form of compound 1 goes to zero at about 540 nm whereas the reduced form has a broad band from 450 to 900 nm with a maximum absorbance at about 650 nm.

Figure 10:
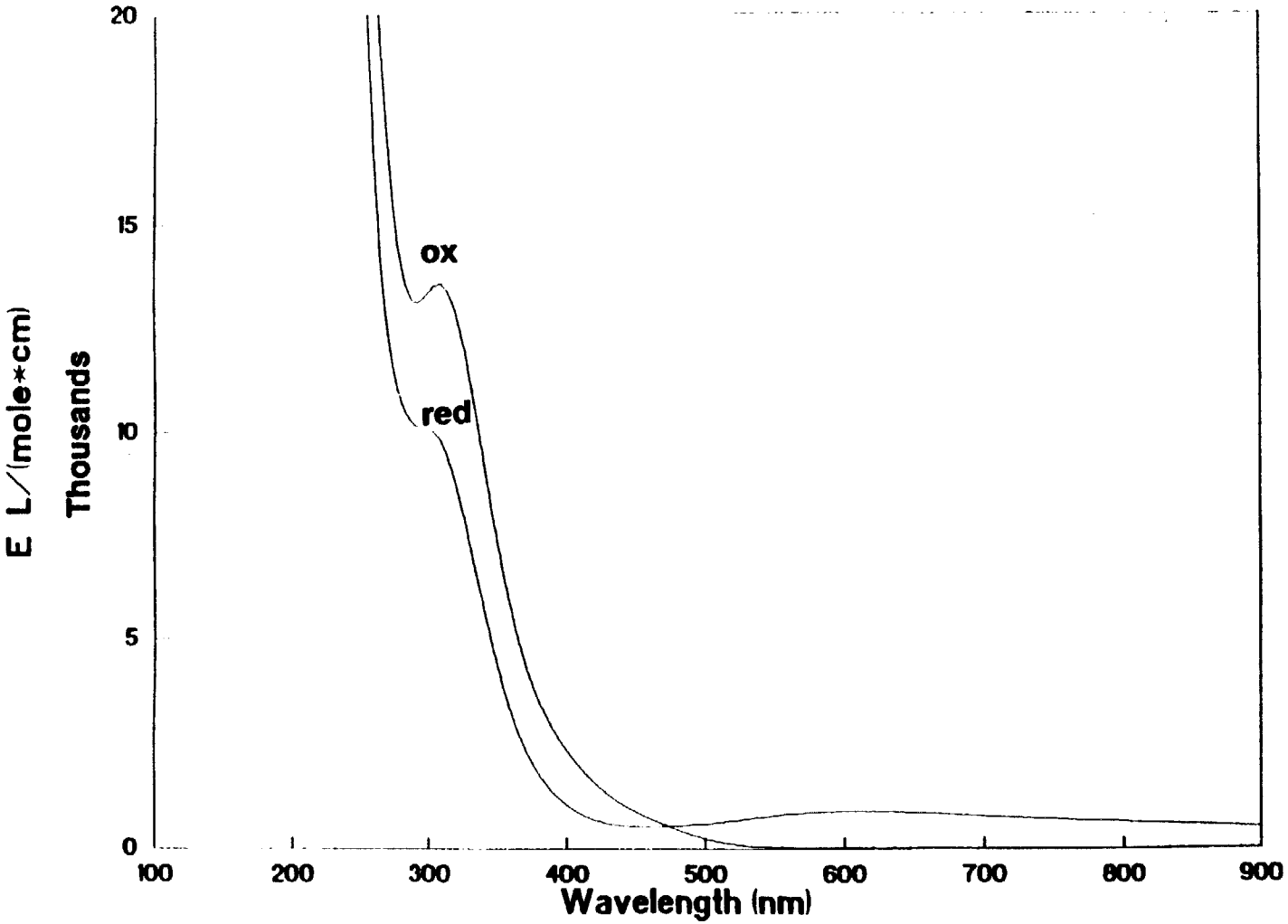
FIG. 10 is a Uv-vis, ε vs λ plot, of solutions of compound 1 partially reduced by use in bleaching (red) and subsequently reoxidized by air (ox).

A 0.10M solution of $H_5[PV_2Mo_{10}O_{40}]$ (compound 1) was used in a bleaching (V) stage as described in Example 1, and subsequently reoxidized with air as described in Example 6. The reduced (red) and reoxidized (ox) Uv-vis spectra are shown in FIG. 10.

EXAMPLE 12

Phosphorus-31 Nuclear Magnetic Resonance Spectra of Polyoxometalate Solutions The integrity of phosphorus-containing polyoxometalates, in aqueous solution, was confirmed by $^{31}P$ NMR spectroscopy. $Na_4[PVW_{11}O_{40}]$ (compound 2) was prepared at the Forest Products Laboratory, and, unlike its close relative, the potassium salt $K_4[PVW_{11}O_{40}]$, may not be a previously isolated material. The $^{31}P$ NMR spectrum serves two purposes; illustration of $^{31}P$ NMR spectroscopy, and, in particular, demonstration that compound 2 is correctly represented as $Na_4[PVW_{11}O_{40}]$.

Figure 11:
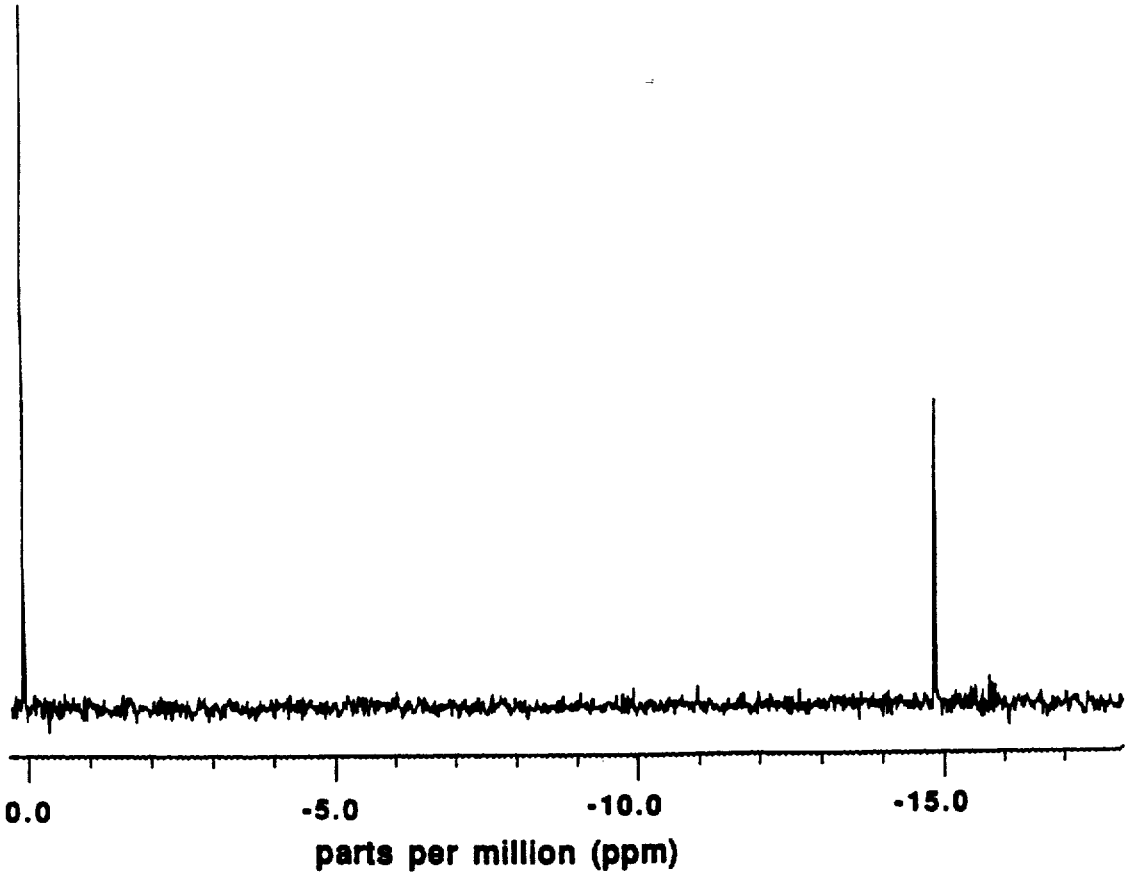
FIG. 11 is a $^{31}P$ NMR spectrum of a solution of compound 2 dissolved in a mixture of water and $D_2O$. Phosphoric acid was added as an internal reference.

The $^{31}P$ NMR spectrum of a sample of compound 2 was diluted with $D_2O$, and phosphoric acid was added as an internal reference. The $^{31}P$ NMR spectrum of this solution is shown in FIG. 11. The chemical shift of phosphorus-31 was reported relative to that of phosphoric acid reference which was set at 0.0 parts per million (ppm). The single signal at −14.89 ppm is attributed to the phosphorus atom located at the center of the heteropolyoxoanion $[PVW_{11}O_{40}]^{4-}$. The literature value for the acid form of this material $H_4[PVW_{11}O_{40}]$, is −14.7. Since no other phosphorus-31 resonances are observed, the observed spectrum confirms that the polyoxometalate solution contains at least 95% of the desired material, $Na_4[PVW_{11}O_{40}]$.

EXAMPLE 13

Use of Compound 1 in Pulping 3 grams of 96% aspen wood meal (the remaining 4% being water) were heated at 84° C. for 1.5 hours, with stirring and gentle aeration (ca. 0.1 L/min of air) in a 0.10M solution of compound 1 at a pH of 0.30. A control was performed by heating 3 grams of 96% aspen wood meal under identical conditions but with no polyoxometalates. The two samples were each subjected to a short Kraft cook and the lignin content of each sample was determined.

The lignin contents of the two samples were analyzed according to TAPPI methods T222 and um-249. The control sample was found to be 18% delignified, while the sample treated with compound 1 was shown to be 50% delignified.

We claim:

1. A method for delignifying wood pulp comprising the steps of:

obtaining a wood pulp; and exposing the wood pulp to a solution of a polyoxometalate of the formula $[V_nMo_mW_lNb_oTa_p(TM)_q(MG)_rO_s]^{x-}$ wherein n is 1–18, m is 0–40, l is 0–40, o is 0–10, p is 0–10, $q \leqq 6$, $r \leqq 6$, TM is a d-electron-containing transition metal ion, and MG is a main group ion, $n+m+o+l+p \geqq 4$, and s is sufficiently large that $x>o$, under conditions of temperature, time, consistency, pH and reactor design wherein the polyoxometalate is reduced and enhanced delignification occurs.

2. The method of claim 1 where in the polyoxometalate is of the formula $[V_nO_r]^{x-}$, where $n \geqq 4$, $r \geqq 12$ and $x=2r-5n$.

3. The method of claim 2 additionally comprising a step of reoxidizing the reduced polyoxometalate with an oxidant.

4. The method of claim 1 wherein the polyoxometalate is of the formula $[V_nMo_mW_o(TM)_p(MG)_qO_r]^{x-}$, where TM is any d-electron-containing transition metal ion, MG is a main group ion, $1 \leqq n \leqq 8$, $n+m+o \leqq 12$ and $p+q \leqq 4$.

5. The method of claim 4 additionally comprising a step of reoxidizing the reduced polyoxometalate with an oxidant.

6. The method of claim 1 wherein the polyoxometalate is of the formula $[V_nMo_mW_o(MG)_pO_r]^{x-}$ where MG is either $P^{5+}$, $As^{5+}$, or $S^{6+}$, $1 \leqq n \leqq 9$, $n+m+o=18$, and $p=2$.

7. The method of claim 6 additionally comprising a step of reoxidizing the reduced polyoxometalate with an oxidant.

8. The method of claim 1 wherein the polyoxometalate is selected from the group consisting of $[PV_2Mo_{10}O_{40}]^{5-}$, $[PVW_{11}O_{40}]^{4-}$, $[P_2V_3W_{15}O_{62}]^{9-}$ and $[V_{10}O_{28}]^{6-}$.

9. The method of claim 8 additionally comprising a step of reoxidizing the reduced polyoxometalate with an oxidant.

10. The method of claim 1 additionally comprising a step of reoxidizing the reduced polyoxometalate with an oxidant.

11. The method of claim 10 wherein the oxidant is selected from the group consisting of air, dioxygen, peroxides and ozone.

12. The method of claim 10 wherein the step of reoxidizing the reduced polyoxometalate is simultaneous with the step of reducing the polyoxometalate.

13. A method for delignifying wood comprising the steps of obtaining a sample of wood fibers; and exposing the wood fibers to a solution of polyoxometalate of the formula $[V_nMo_mW_lNb_oTa_p(TM)_q(MG)_rO_s]^{x-}$ where n is 1–18, m is 0–40, l is 0–40, o is 0–10, p is 0–10, $q \leqq 6$, $r \leqq 6$, TM is a d-electron-containing transition metal ion, and MG is a main group ion, $n+m+o+l+p \geqq 4$ and s is sufficiently large that $x>o$, under conditions of temperature, time, consistency, pH and reactor design wherein the polyoxometalate is reduced and enhanced delignification occurs.

* * * * *